US007334669B2

(12) United States Patent
Barker et al.

(10) Patent No.: US 7,334,669 B2
(45) Date of Patent: Feb. 26, 2008

(54) ROLLING LUGGAGE WITH EXPANDABLE COMPARTMENT

(76) Inventors: Deborah Barker, 6550 N. Federal Highway, Suite 240, Ft. Lauderale, FL (US) 33308; Bradd Barker, 6550 N. Federal Highway, Suite 240, Ft. Lauderale, FL (US) 33308

( * ) Notice: Subject to any disclaimer, the term of this patent is extended or adjusted under 35 U.S.C. 154(b) by 167 days.

(21) Appl. No.: 10/881,872

(22) Filed: Jun. 30, 2004

(65) Prior Publication Data

US 2006/0000681 A1 Jan. 5, 2006

(51) Int. Cl.
*A45C 5/14* (2006.01)
*A45C 7/00* (2006.01)
*A45C 13/02* (2006.01)

(52) U.S. Cl. ..... 190/104; 190/18 A; 190/15 R; 190/119; 220/8; 383/2

(58) Field of Classification Search ..... 190/14, 190/15 R, 15 A, 18 A, 103–105, 113, 22, 190/35, 36, 107, 127; 220/8; 383/2
See application file for complete search history.

(56) References Cited

U.S. PATENT DOCUMENTS 643,416 A * 2/1900 Kohout et al. ..... 190/15 R
825,642 A * 7/1906 Enright ..... 190/15 R
1,126,479 A * 1/1915 Jozsy ..... 190/15 R
1,184,525 A * 5/1916 Hammond ..... 190/104
1,344,408 A * 6/1920 King ..... 190/15 R
1,756,775 A * 4/1930 Winning ..... 292/281
1,842,578 A * 1/1932 Bracken ..... 190/35
2,079,476 A * 5/1937 Wolff ..... 190/105
2,176,792 A * 10/1939 Currie ..... 206/289
2,517,757 A * 8/1950 Adlerstein ..... 312/3
2,565,969 A * 8/1951 Judson ..... 190/15 R
2,792,980 A 5/1957 Brown
2,907,420 A * 10/1959 Doppelt ..... 190/103
3,231,120 A 1/1966 Dempster et al.
4,267,905 A * 5/1981 Stewart ..... 190/13 R
4,345,802 A * 8/1982 Sorensen ..... 312/42
4,506,769 A 3/1985 Franco et al.
4,538,709 A * 9/1985 Williams et al. ..... 190/18 A
4,624,382 A 11/1986 Tontarelli
4,830,154 A * 5/1989 Gerch et al. ..... 190/103
4,887,751 A * 12/1989 Lehman ..... 224/579
4,890,705 A * 1/1990 Pineda ..... 190/18 A
4,998,603 A * 3/1991 Nordstrom ..... 190/18 A
5,038,842 A * 8/1991 Huang ..... 150/113

(Continued)

*Primary Examiner*—Sue A. Weaver
(74) *Attorney, Agent, or Firm*—Mark D. Bowen, Esq.; Stearns Weaver Miller Weissler Alhadeff & Sitterson P.A.

(57) ABSTRACT

Wheeled luggage having a telescopically expandable body is disclosed. The luggage body may be manually adjusted from a normally sized carry-on configuration during transit, to a vertically enlarged configuration once the final destination, such as a hotel room, is reached. The body further includes a plurality of interior horizontally disposed, vertically stacked shelves connected in accordion fashion to an internal liner so as to automatically expand from a compact configuration to an expanded configuration when the main body is telescopically expanded thereby providing a series of vertically spaced shelves which provide convenient access to the contents. A garment folding apparatus may be incorporated with the luggage to provide a tool that assists the user in quickly folding clothing to dimensions compatible with storage spaced within the luggage.

5 Claims, 27 Drawing Sheets

U.S. PATENT DOCUMENTS 5,042,664 A * 8/1991 Shyr et al. ..... 206/579
5,082,094 A * 1/1992 Nechushtan ..... 190/105
5,230,690 A 7/1993 Adkinson et al.
5,251,731 A * 10/1993 Cassese et al. ..... 190/107
5,255,766 A * 10/1993 Deconinck ..... 190/36
5,415,311 A 5/1995 Coogan
5,431,262 A * 7/1995 Rekuc et al. ..... 190/18 A
5,518,170 A 5/1996 Rasmussen
5,526,907 A 6/1996 Trawick et al.
5,562,225 A 10/1996 McKenna
5,743,447 A * 4/1998 McDermott ..... 224/153
5,782,372 A * 7/1998 Weiss et al. ..... 220/8
5,819,891 A * 10/1998 Wang et al. ..... 190/103
5,878,903 A * 3/1999 Ung ..... 220/8
5,988,476 A 11/1999 Olerio
6,161,739 A 12/2000 Bentzen
6,179,101 B1 * 1/2001 Lin ..... 190/103
6,237,761 B1 * 5/2001 Godshaw et al. ..... 206/297
6,298,964 B1 * 10/2001 Sadow ..... 190/18 A
6,401,890 B1 * 6/2002 Tan ..... 190/107
6,533,152 B1 * 3/2003 Dischler ..... 224/413
2002/0125669 A1 * 9/2002 Chang ..... 280/79.11
2004/0020732 A1 * 2/2004 Chen ..... 190/18 A
2004/0173427 A1 * 9/2004 Chernoff ..... 190/108
2005/0121275 A1 * 6/2005 Platte, III ..... 190/103
2005/0230936 A1 * 10/2005 Van Horn et al. ..... 280/641
2005/0268622 A1 * 12/2005 Krieger ..... 62/3.6

* cited by examiner

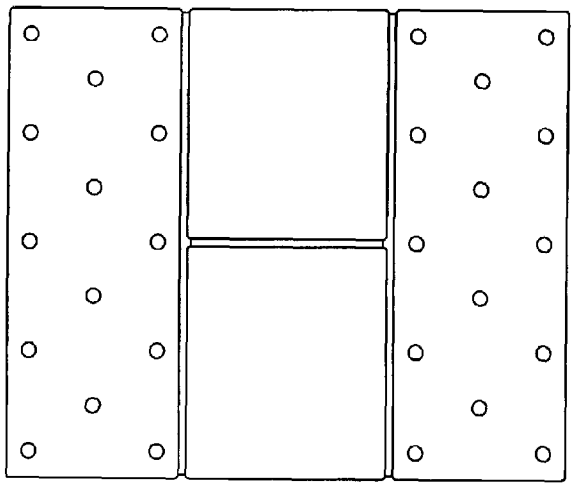
FIG. 13
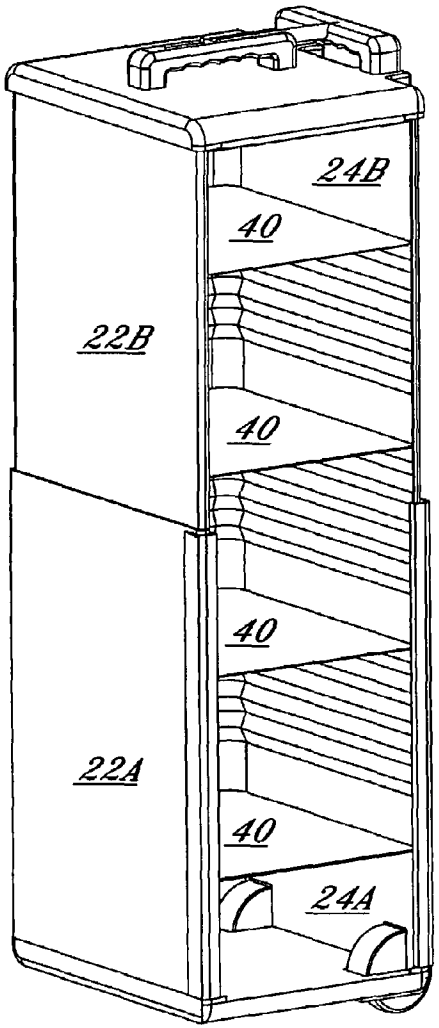

ROLLING LUGGAGE WITH EXPANDABLE COMPARTMENT

CROSS REFERENCE TO RELATED APPLICATIONS

N/A

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to traveler's luggage cases and more particularly to a vertically expandable luggage case which is equipped with wheels to facilitate movement of the case along a floor, walkway or the like.

2. Description of Related Art

The task of carrying and/or lifting luggage at airports, railway stations, hotels or other sites is generally disliked by travelers. While rental luggage carts are available at certain sites, the renting process is itself an inconvenience and such carts do not remain with the traveler after the baggage is checked in.

As a result, the use of wheeled luggage cases has significantly expanded to the point where wheeled luggage case are now the norm in the art of luggage making. Even relatively small luggage cases designed to fit in overhead compartments or under the seats on aircraft are commonly adapted with wheels to facilitate transporting a loaded case. Currently, the most popular type of wheeled luggage is the upright case, which is pushed or towed with the longest or major dimension nearer to vertical than horizontal. Typically, upright cases are equipped with a telescopically extendable and retractable wheel handle at the top end of the body of the case and a pair of wheels at the bottom edge of the back of the body. At rest, the case may sit in an upright position upon the wheels and a pair of legs or glides. To roll the case, the user grips the wheel handle and tips the case to lift the glides from the supporting surface and manually pulls the case while walking.

A significant disadvantage associated with luggage carriers is that the main packing compartment is small and difficult to pack in a way that the packed clothing and other items are easily accessible when the case is opened up, for example, in the upright position when it's standing on the pair of wheels. As a result of this shortcoming, the prior art reveals attempts to improve upon internal organization by providing shelves that divide the interior of the case. For example, U.S. Pat. No. 6,161,739, issued to Bentzen, discloses a non-wheeled upright backpack having an internal compartment that is divided into subcompartments by shelves that are removable. U.S. Pat. No. 5,988,476, discloses a rack system for a backback. Such attempts to integrate shelves into luggage and backpacks have not resulted in widespread success, and fail to address the inherent space limitation due to the relatively small size of the compartment provided by the luggage.

Accordingly, there exists a need for wheeled luggage having an expandable storage compartment and internal shelving to provide organized storage for travelers.

BRIEF SUMMARY OF THE INVENTION

The present invention overcomes the disadvantages and limitations in the art by providing wheeled luggage having a main body having an storage compartment that is expandable and adapted with internal shelves so as to enable a traveler to transport the fully packed case to a final destination and expand the main body to form a vertically expanded configuration wherein the articles therein are readily accessible and disposed on a plurality of vertically spaced shelves. In accordance with the present invention, wheeled luggage is provided including a case having a body defining an interior that serves as container in which clothing and other personal items may be placed for transportation. The body is of the type that stands vertically upright, and is further adapted so as to be telescopically expandable such that the body may be manually adjusted from a normally sized configuration during transit to a vertically enlarged configuration once the final destination, such as a hotel room, is reached. More particularly the body includes a telescopically adjustable main body, to allow for selective vertical extension of the body thereby substantially increasing the volume of the interior storage compartment. The body further includes a plurality of interior horizontally disposed, vertically stacked shelves connected in accordion fashion so as to automatically expand from a compact configuration to an expanded configuration when the main body is telescopically expanded thereby providing a series of vertically spaced shelves which provide convenient access to the contents.

Accordingly, a traveler using the luggage case disclosed herein is relieved of the time consuming task of having to unpack the case upon reaching his/her destination A further aspect of the present invention includes combining a garment folding apparatus as an integral component of the luggage main body. The folding apparatus provides the user with a tool to assist in rapidly folding garments, such as shirts, tops, and pants, into precisely folded shapes sized to fit conveniently within the main body interior and to fit neatly on the shelves provided therein.

Accordingly, it is an object of the present invention to provide improvements in the field of wheeled luggage.

Another object of the present invention is to provide luggage having an expandable body.

Yet another object of the present invention is to provide in combination wheeled luggage and a garment folding apparatus for use therewith.

Still another object of the present invention is to provide wheeled luggage having internal shelf dividers.

In accordance with these and other objects, which will become apparent hereinafter, the instant invention will now be described with particular reference to the accompanying drawings.

BRIEF DESCRIPTION OF THE SEVERAL VIEWS OF THE DRAWINGS

FIG. 13 is a front perspective view thereof showing the front closure panel/garment folding device removed and unfolded;

DETAILED DESCRIPTION OF THE INVENTION

Figure 1:
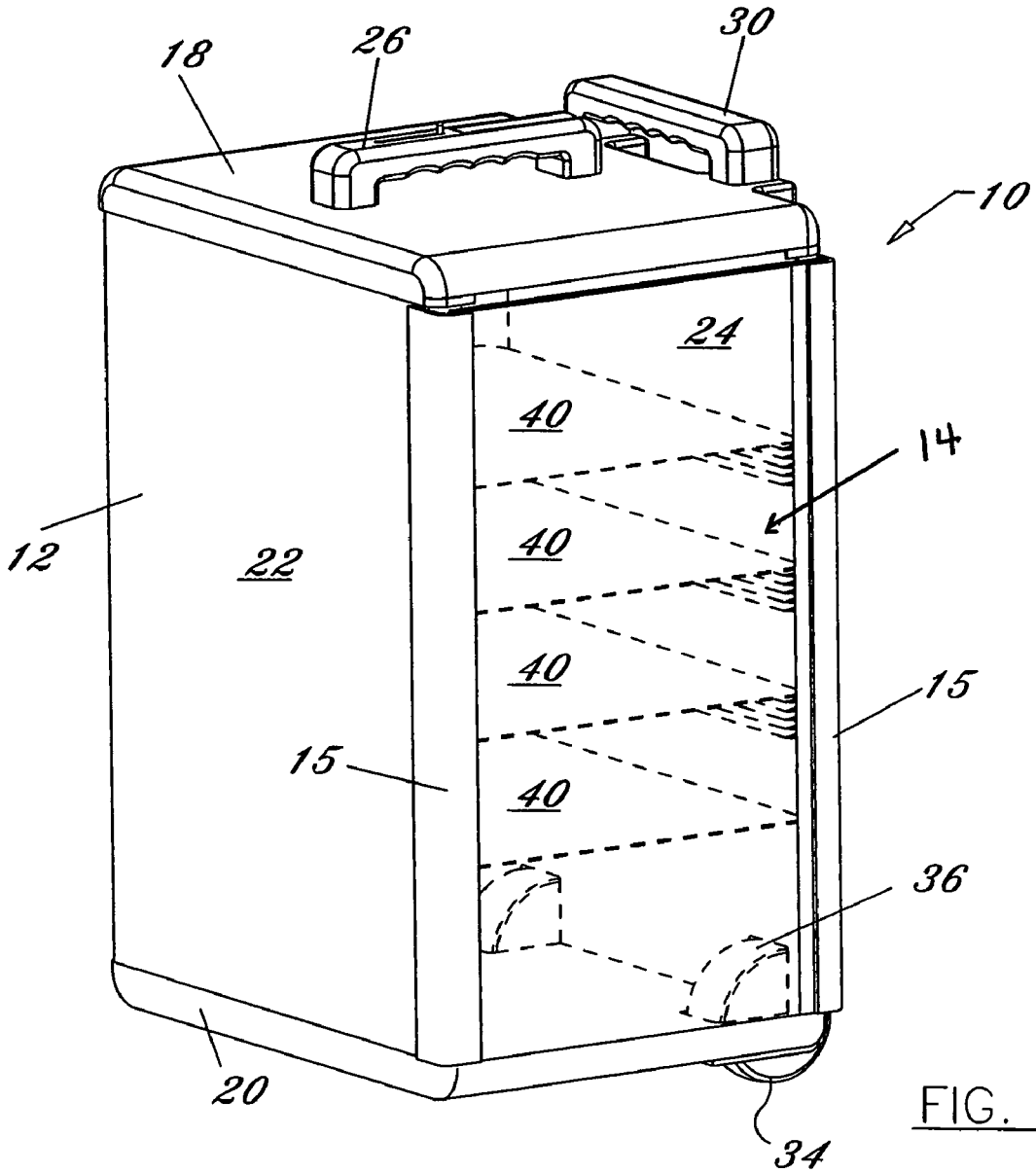
FIG. 1 is a front perspective view of wheeled luggage according to the present invention.

With reference to the drawings, FIGS. 1-25 depict a preferred embodiment of the invention. Broadly described, the invention includes a case 10 having a body 12 that functions as a container in which clothing and other personal items may be placed for transportation. Case 10 may is preferably sized to conform to the maximum dimensions for "carry on" luggage to be carried aboard and stowed in passenger cabins in aircraft, buses, and the like, but may be any suitable size. In a preferred embodiment case 10 will not have length, width, and height dimensions that exceed a sum total of forty-four inches (44"), and is preferably about 20" high about 10" deep and 14" wide when in the compact "carry-on" configuration, however, other dimensional configurations are considered within the scope of the present invention. Body 12 is preferably hard-side construction as known in the art, but an alternative embodiment fabricated as soft-side construction is considered within the scope of the present invention.

As best depicted in FIGS. 1-13, body 12 defines a generally hollow interior for receiving clothing and the like and the exterior may feature various handles, piping, pockets, and the like, as depicted or as otherwise are used in the luggage art. Body 12 has a front 14, a back 16, a top 18, a bottom 20 and two opposing sides 22 and 24. Top 18 preferably includes a handle 26 attached thereto to assist in lifting case 10, and for other reasons discussed herein below.

Figure 2:
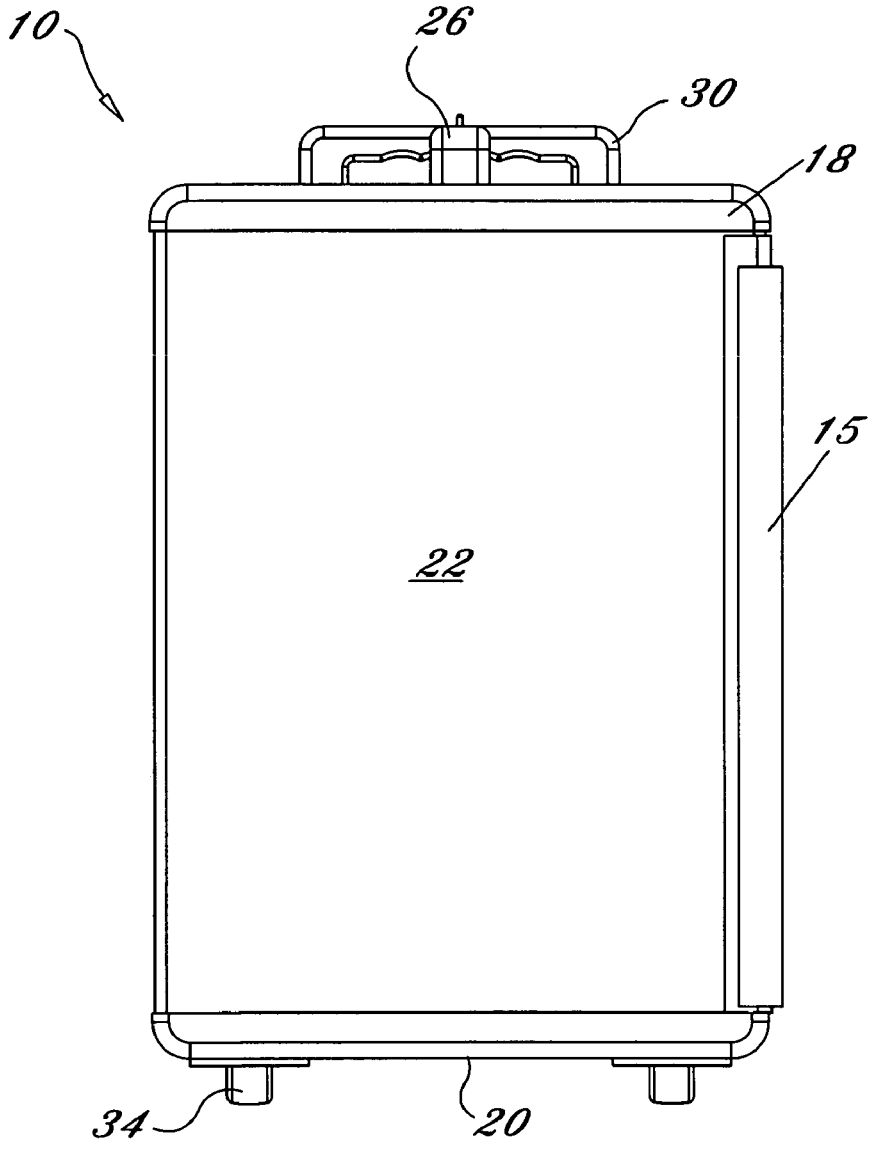
FIG. 2 is a left side view thereof.
Figure 3:
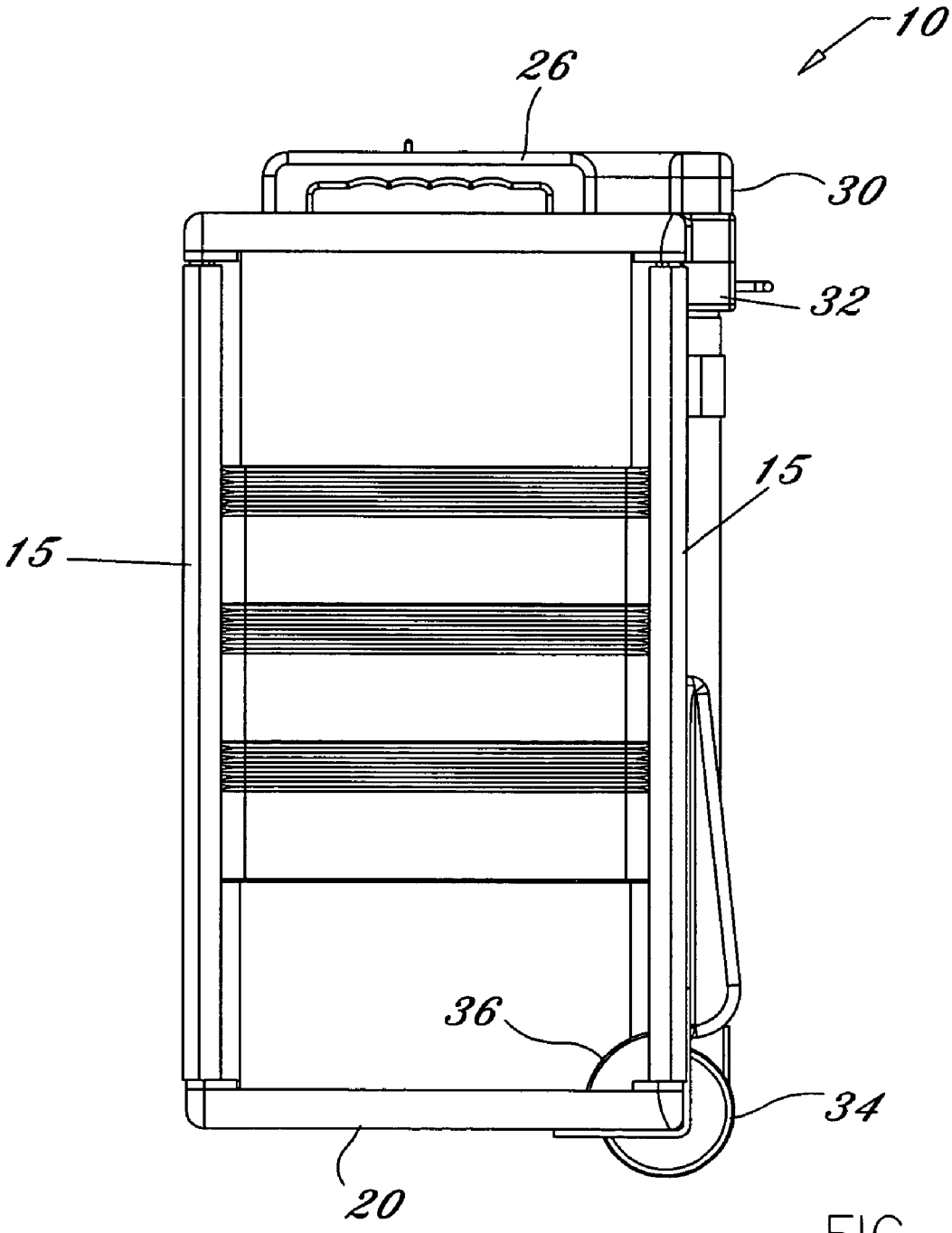
FIG. 3 is a front view thereof with the front closure panel removed.
Figure 4:
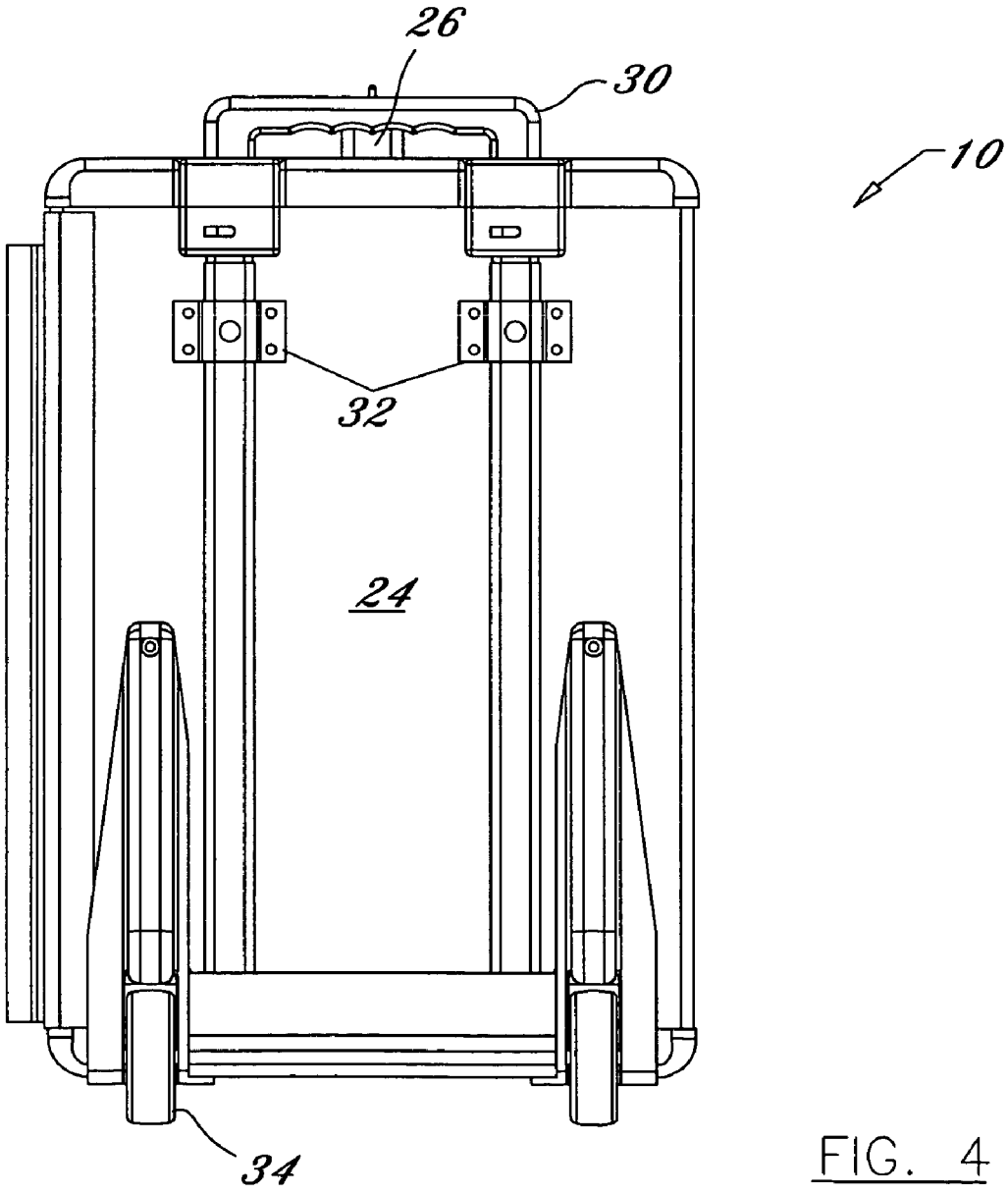
FIG. 4 is right side view thereof.
Figure 5:
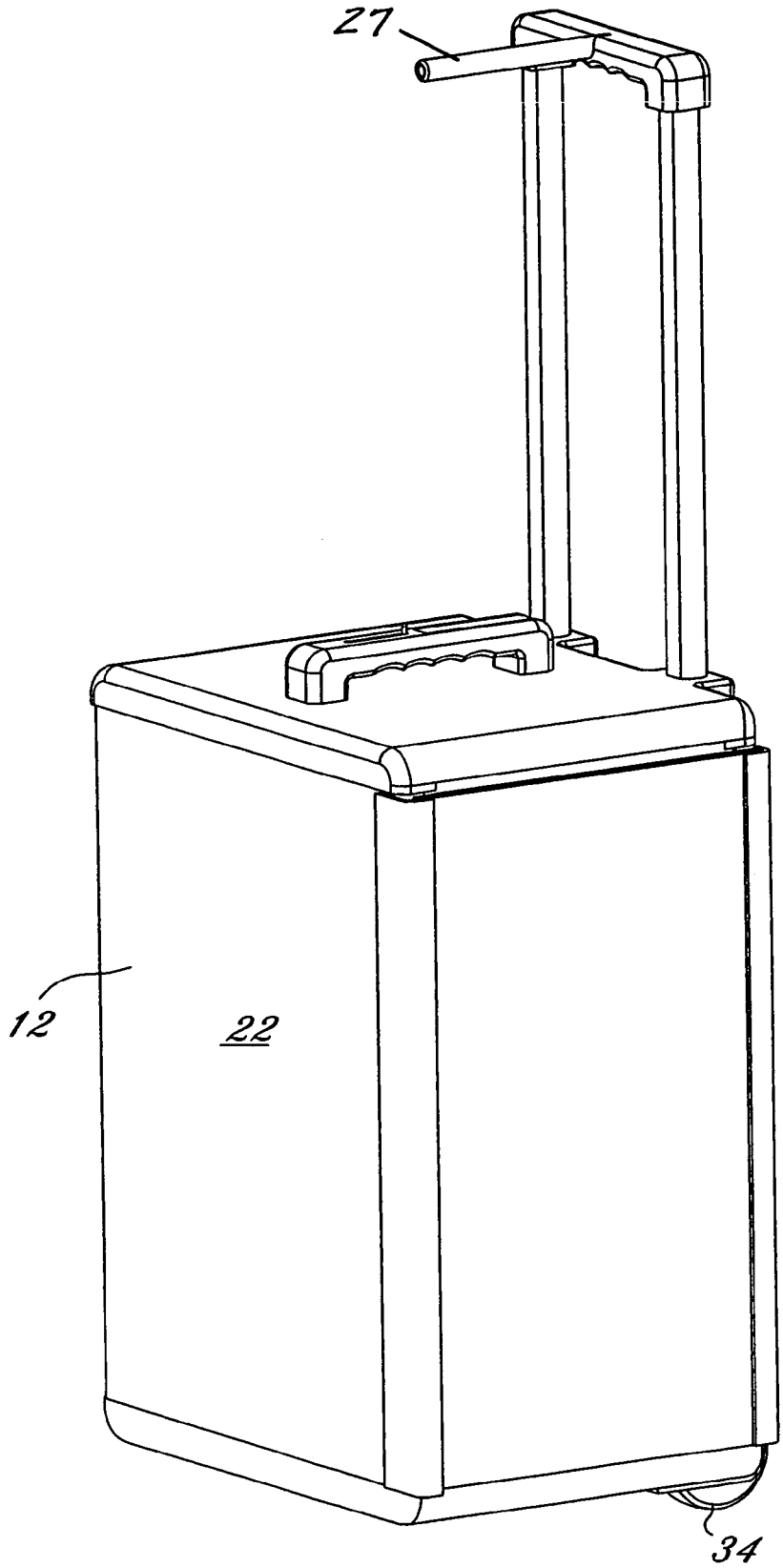
FIG. 5 is a front perspective view thereof with the handle extended.
Figure 6:
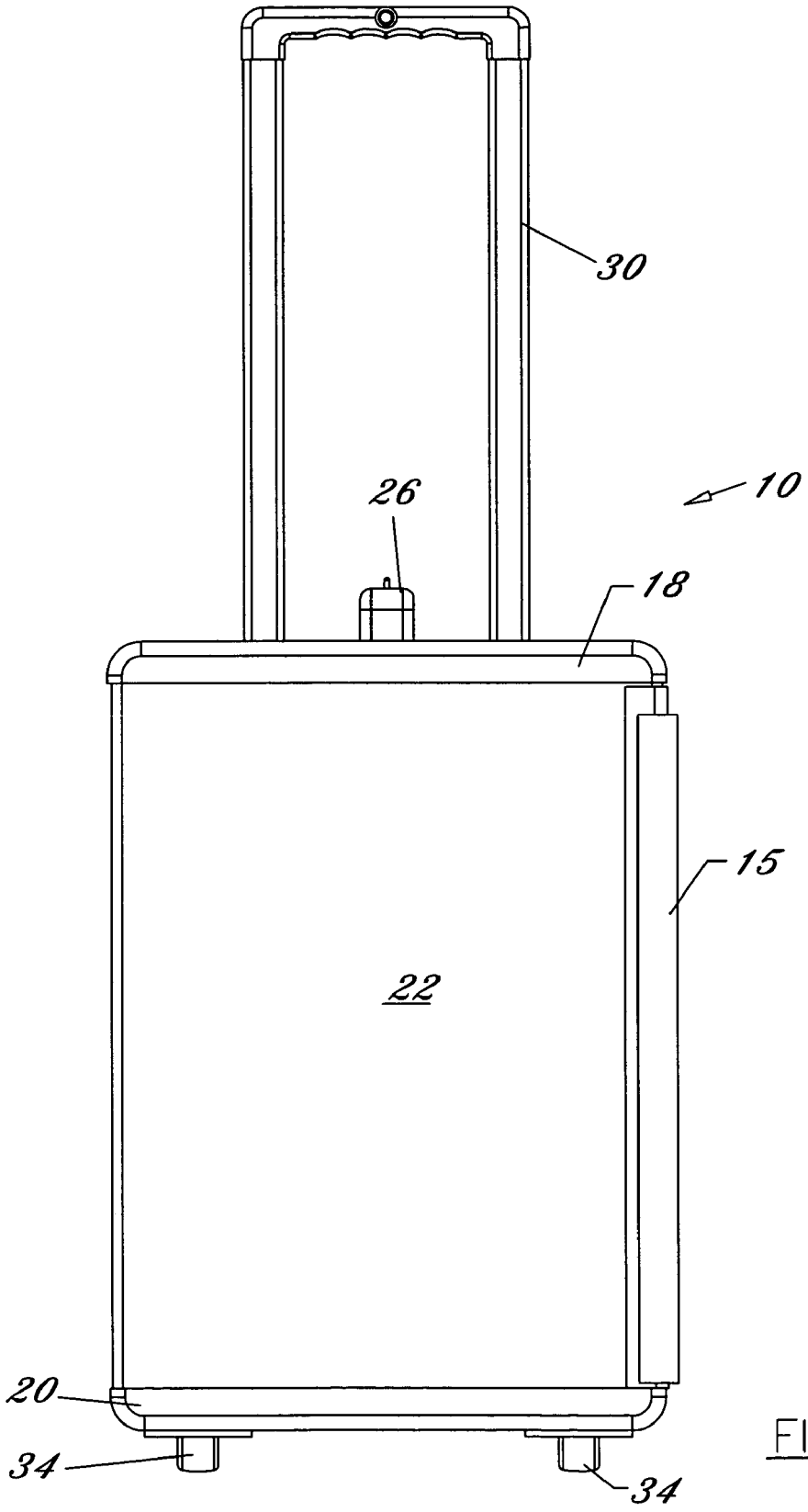
FIG. 6 is left side view thereof.
Figure 7:
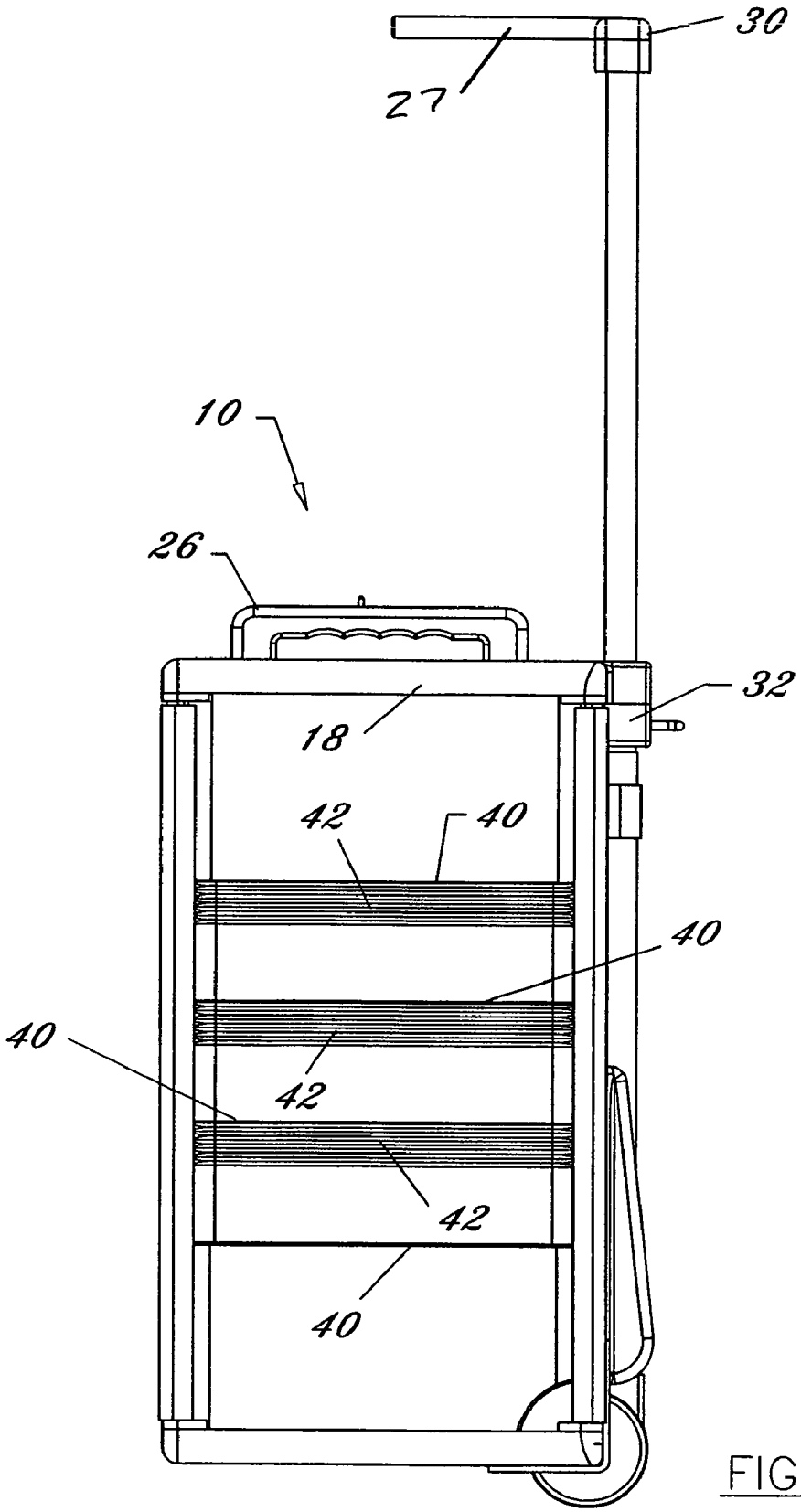
FIG. 7 is a front view thereof with the handle extended and the front closure panel removed.
Figure 8:
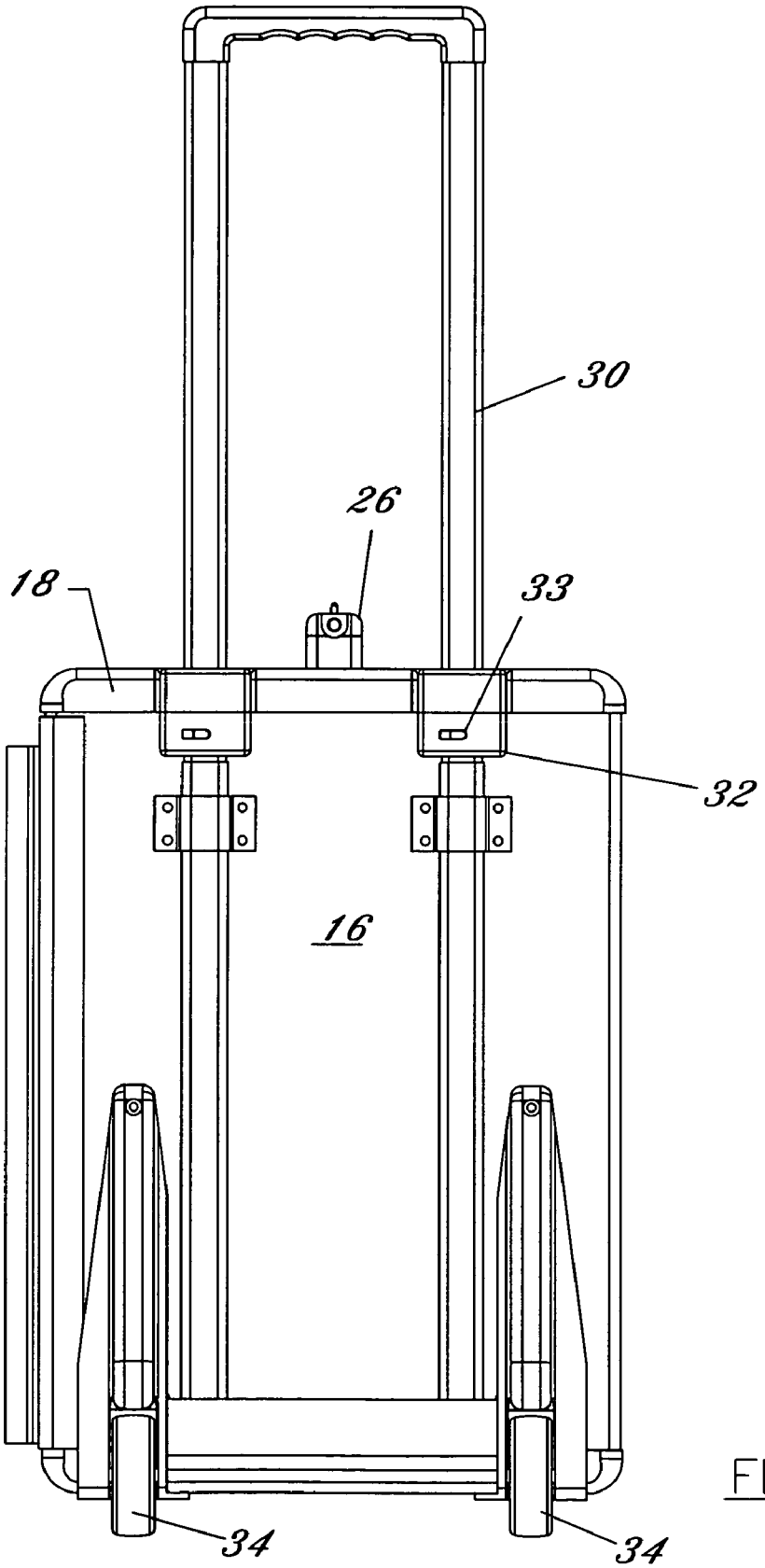
FIG. 8 is a right side view thereof with the handle extended.
Figure 9:
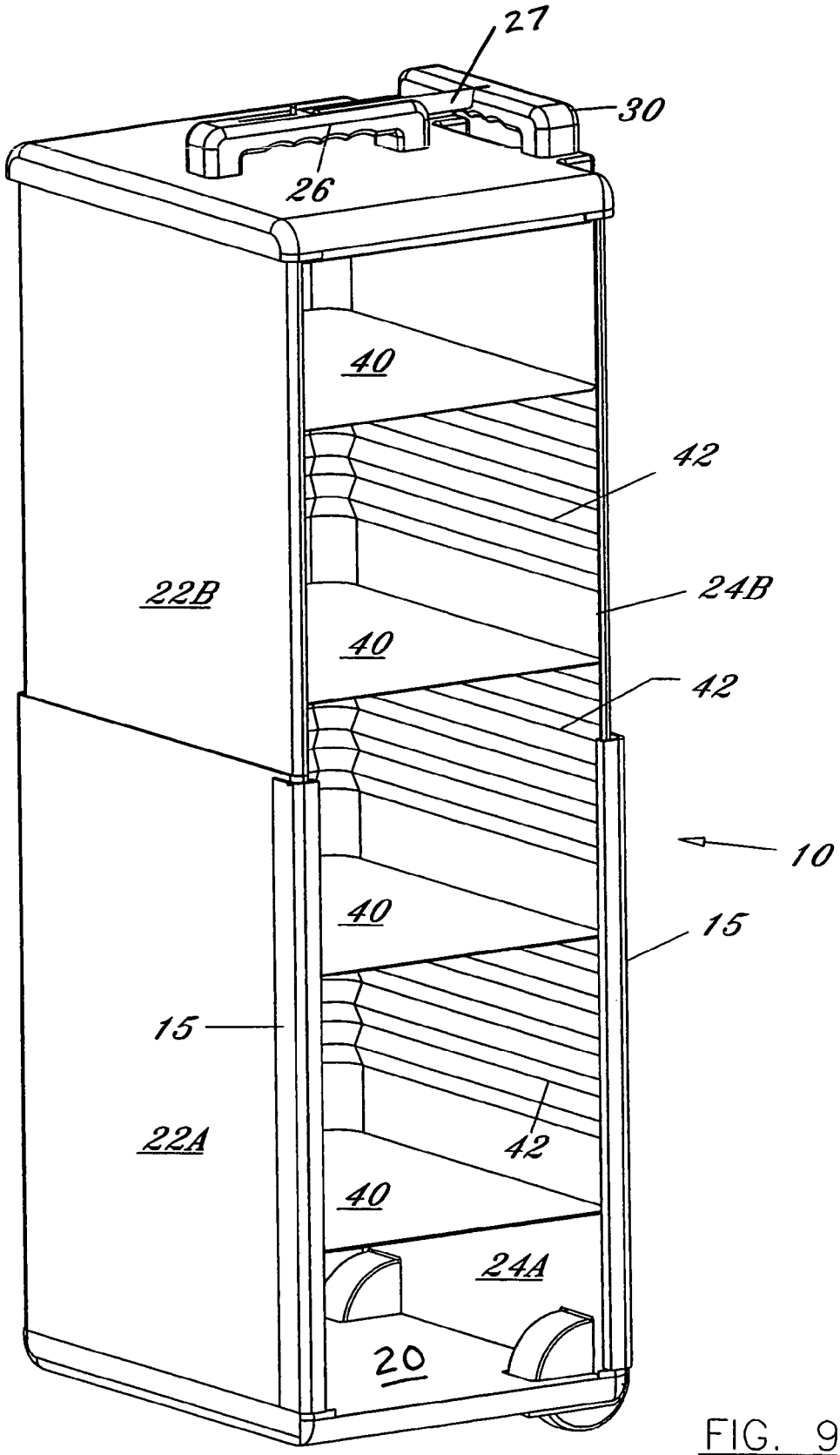
FIG. 9 is a front perspective view thereof in a vertically expanded configuration.
Figure 10:
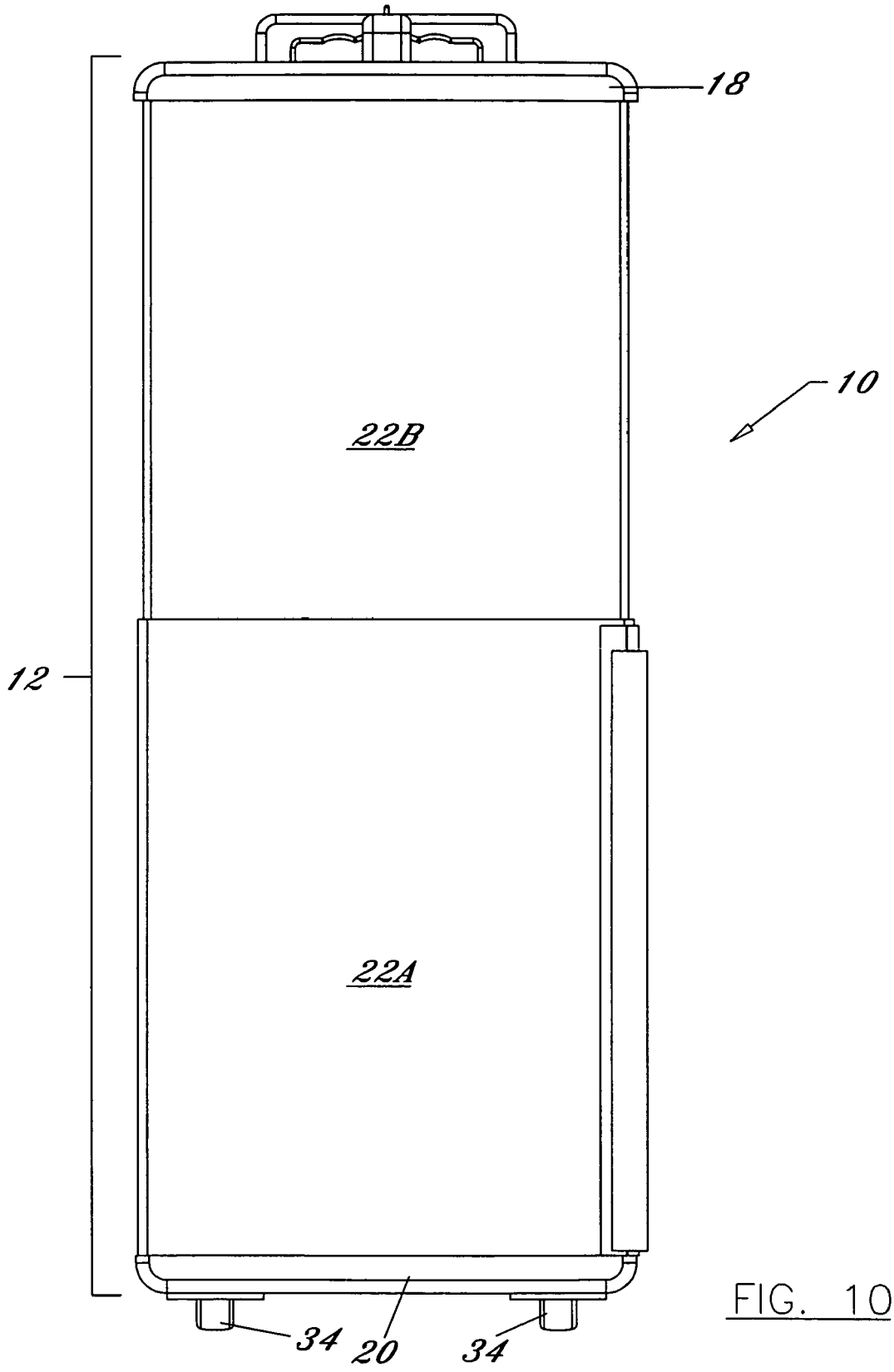
FIG. 10 is a left side view thereof.
Figure 11:
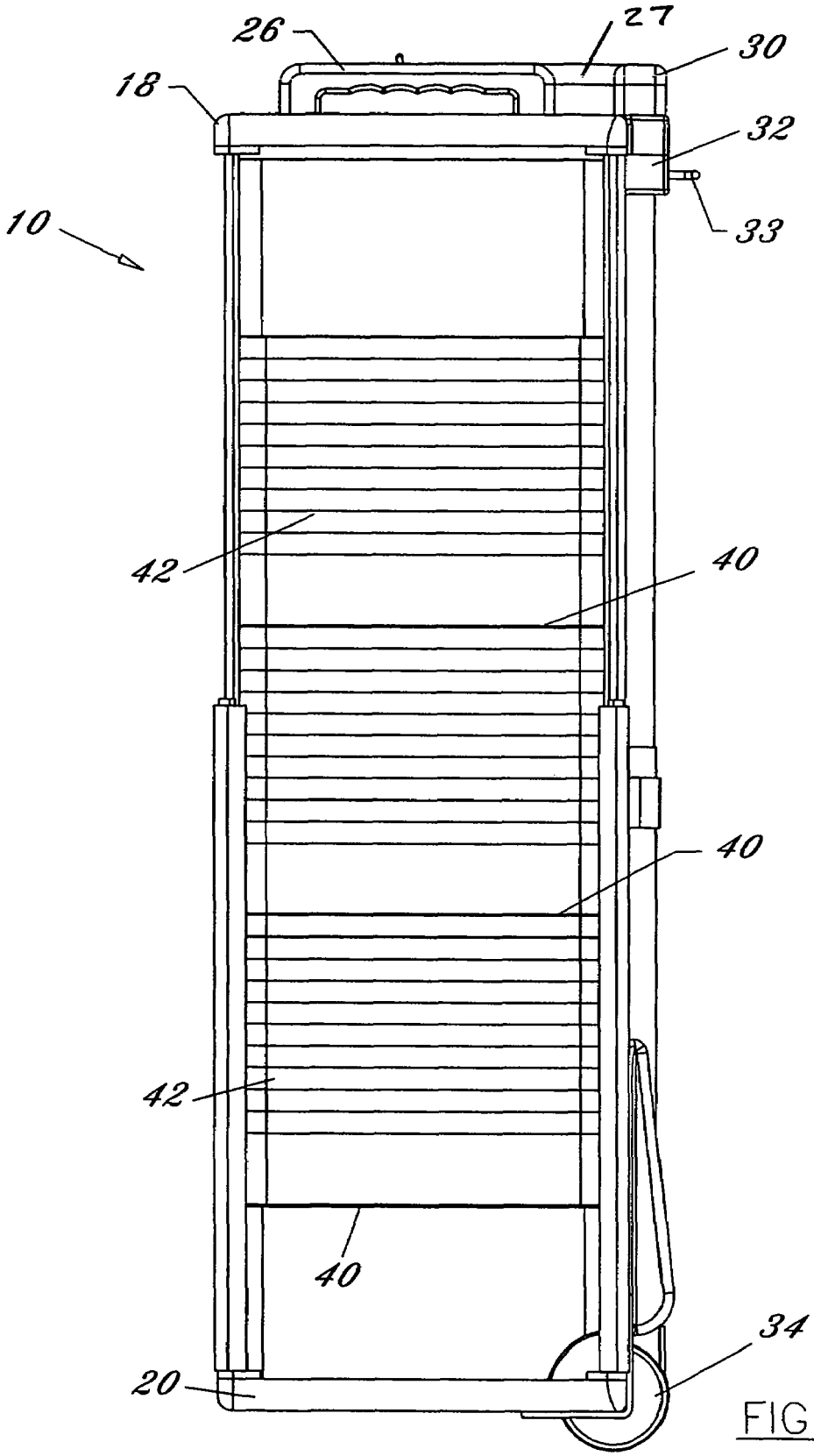
FIG. 11 is a front view thereof.
Figure 12:
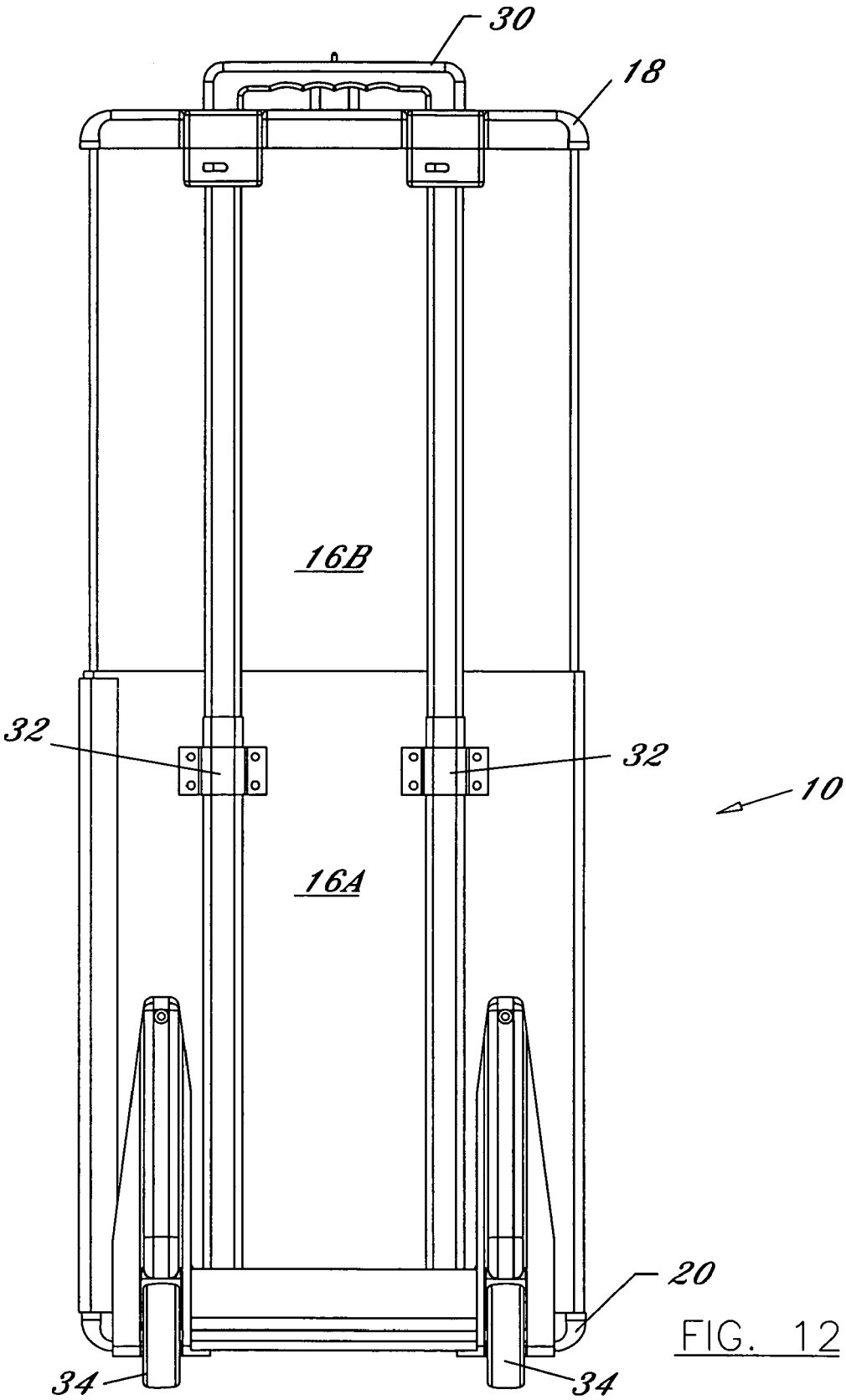
FIG. 12 is a right side view thereof.
Figure 14:
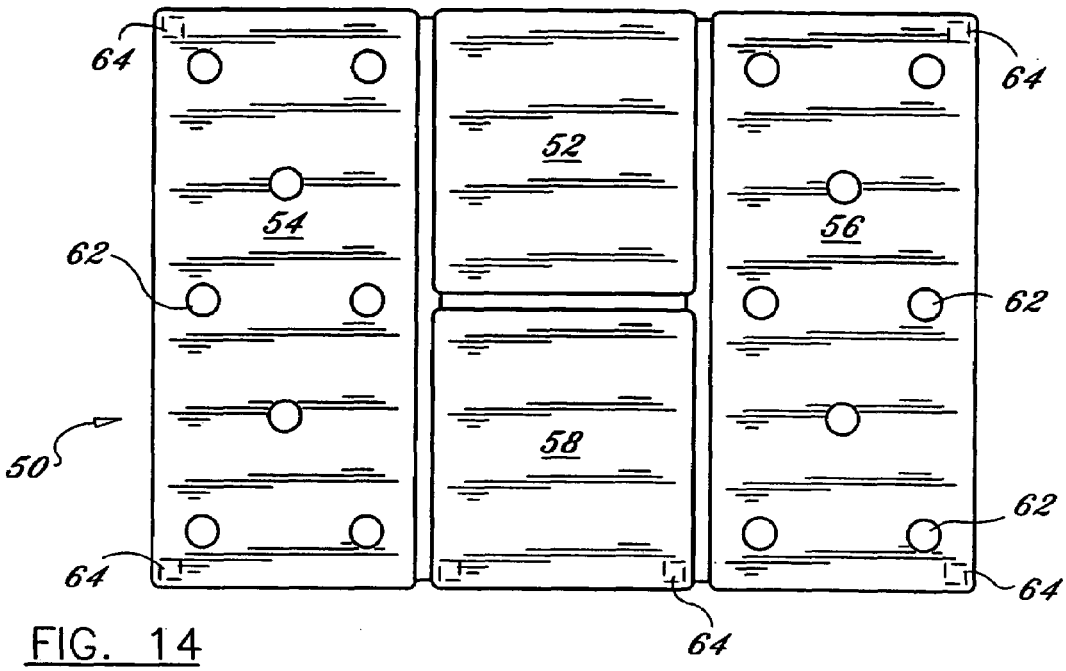
FIG. 14 is a top plan view of the front closure panel that doubles as a garment folding apparatus.
Figure 15:
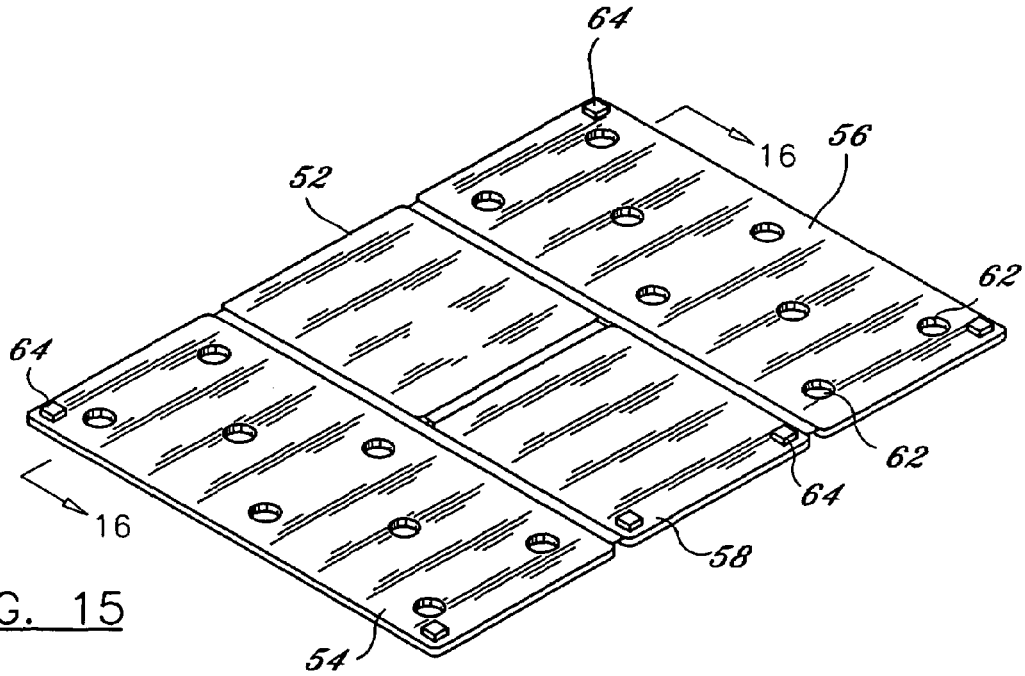
FIG. 15 is a top perspective view thereof.

In addition, case 10 is preferably equipped with an extendible/retractable handle 30 with which the case 10 may be pushed or pulled across a supporting surface. Handle 30 may be extended and locked in the extended configuration by a simple mechanical locking apparatus. For example, pillow blocks 32 may each be adapted with a locking set-screw or lever actuated cam lock device 33. In an alternate embodiment, handle 30 may be foldable or rotatable from a stowed configuration to a deployed configuration. In a preferred embodiment, case 10 has two wheels 34 rotatably mounted within wheel housings 36 proximate to the lower rear corners of the body 12. Wheels 34 permit the case 10, with wheel handle 30 extended as shown in FIG. 2, to be tipped slightly from vertical and wheeled along the ground in a generally upright position as is customary in the art. When case 10 is not in use, handle 30 may be retracted by known methods to the position depicted in FIGS. 1-4.

A significant aspect of the present invention relates to expandability. More particularly, back 16 and opposing sides 22 and 24, are each composite structures including adjacent, slidably engaged outer and inner members identified by individually as 16A/16B, 22A/22B, and 24A/24B. Each outer member 16A, 22A and 24A is attached at the lower peripheral edges thereof to bottom 20. Each inner member 16B, 22B, and 24B is attached at the upper peripheral edges thereof to top 18. Accordingly, body 12 is telescopically adjustable, and may be selectively manipulated between a compact configuration depicted in FIGS. 1-4, to an expanded configuration depicted in FIGS. 9-12. Body 12 is preferably maintained in the expanded configuration by connection of extended handle 30 with top handle 26 so as to maintain body 12 in the expanded configuration. Connection of handles 30 and 26 may be accomplished by any suitable mechanical connection. In a preferred embodiment, handle 26 includes a slidable rod 27 that is positionable from a retracted position wherein rod 27 is received within handle 26, to a deployed position wherein rod 27 is extended to engage handle 30 thus supporting top 18 in the vertically expanded configuration.

Furthermore, the interior of case 10 preferably includes a plurality of horizontal shelves, referenced as 40 for use in storing clothes and personal items within case 10. Shelves 40 may be attached to an internal, vertically expandable liner 42 that is connected to body 12, such as to top 18, so as to expand upward in an accordion manner when case 10 is configured to the expanded configuration depicted in FIGS. 9-12. By incorporating an expandable shelving system within case 10, the user may configure the case to the expanded configuration depicted in FIG. 9 while packing the case, then close the case by configuring same to the compact configuration depicted in FIGS. 1-8 wherein case 10 may be transported during travel. Once the user has arrived at his/her destination, case 10 may be opened and configured to the expanded configuration thereby increasing the vertical spacing of shelves 40. In the expanded configuration, the clothing and personal items stored within the case remain neatly stacked, and readily accessible due to the expansion of the interior volume and increased vertical spacing between individual shelf members. The present invention thus provides an expandable case that saves the user significant time while traveling since the user may leave his/her clothing and personal items neatly within the case and thus is relieved of the duties related to unpacking the case. A further advantage realized by the use of the expandable shelving system of the present invention relates to the visibility of the packed clothing and articles when the case is configured to the expanded configuration as the clothing and articles remain on the shelves, visible, and accessible to the user.

It should be noted, however, that in an alternate embodiment shelves 40 may be fixed within the case. In addition, the present invention contemplates the use of vertical dividers, either in lieu of shelves or in addition thereto. The use of vertical dividers is considered desirable for an embodiment of the present invention particularly directed to use by persons in carrying files or other items more suitably transported in a vertical orientation.

A further significant aspect of the present invention includes providing a garment folding tool for use in rapidly folding clothing, such as shirts and tops, as an integral component. Such a garment folding tool is disclosed in U.S. Pat. No. 6,360,927, the disclosure of which is hereby incorporated herein by reference. More particularly, case 10 is adapted with vertically disposed, U-shaped channel members 15 on opposing sides of front opening 14. Channel members 15 are intended to receive a garment folding tool 50 that is removably received in the otherwise open front 14 of body 12 thereby functioning as a closure panel. Folding tool 50 includes four (4) hingedly connected panels including a main panel, opposing side panels, and a bottom panel. The opposing side panels and the bottom panel are each pivotally connected to the main panel. The pivotal connections permit folding of the panels during use and further permit the device to be configured for compact storage.

Figure 16:
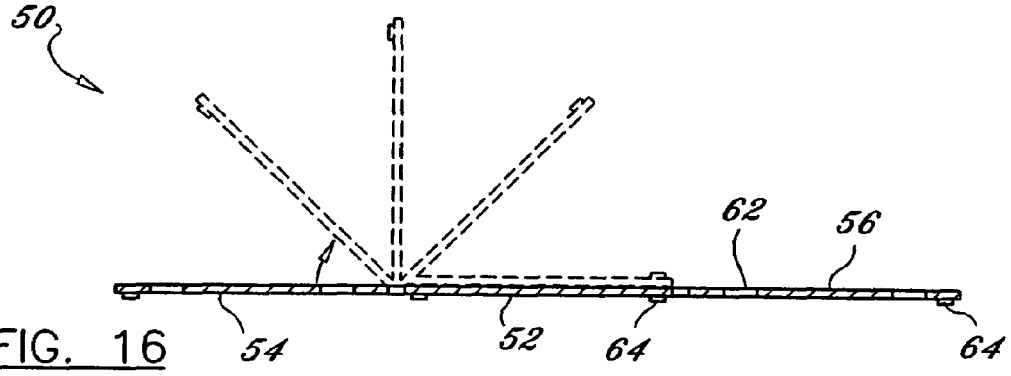
FIG. 16 is a side view thereof and illustrates the flipping of the left side panel.
Figure 25:
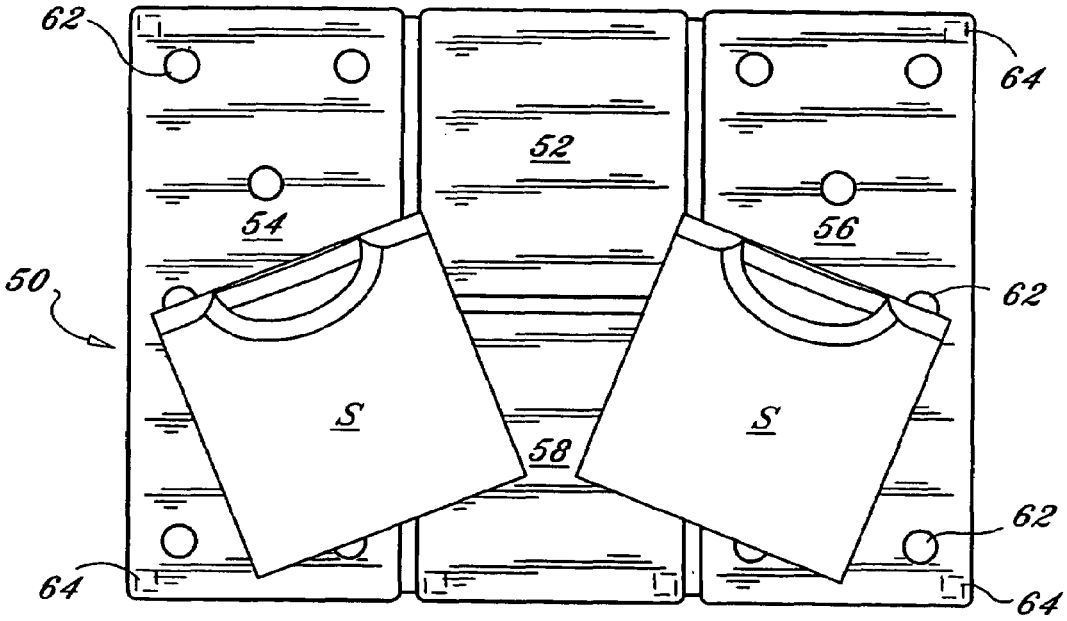
FIG. 25 is a top plan view of the garment folding apparatus and shirts folded therewith.
Figure 26:
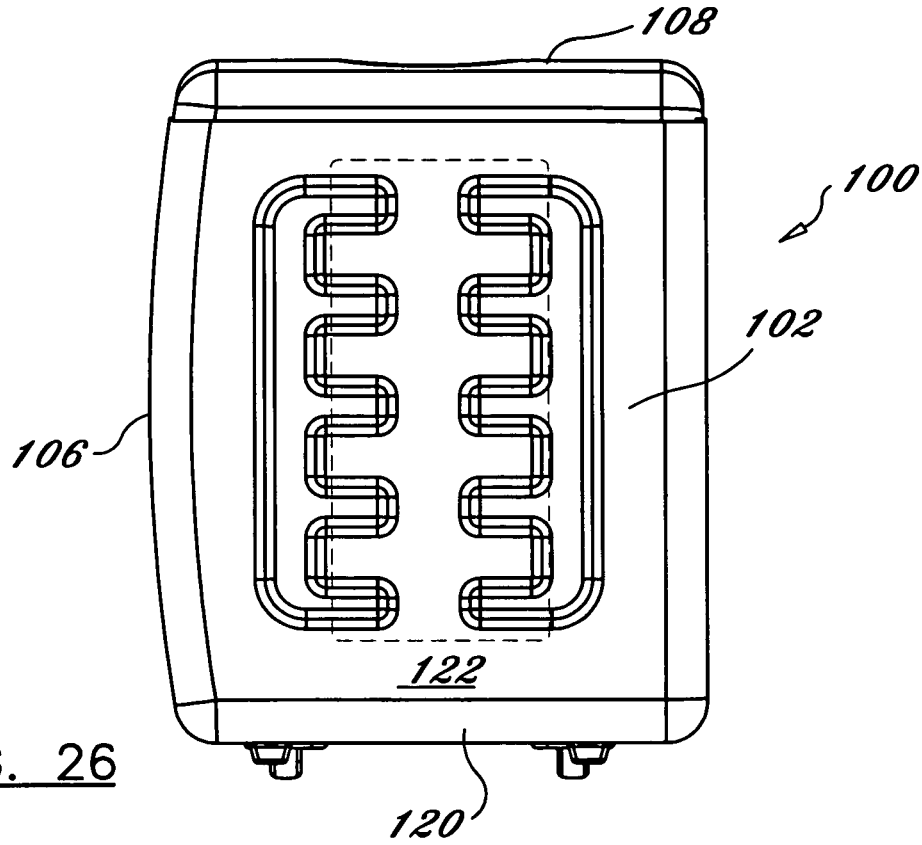
FIG. 26 is a left side view of an alternate embodiment vertically expandable wheeled luggage apparatus according to the present invention in the compact configuration.
Figure 27:
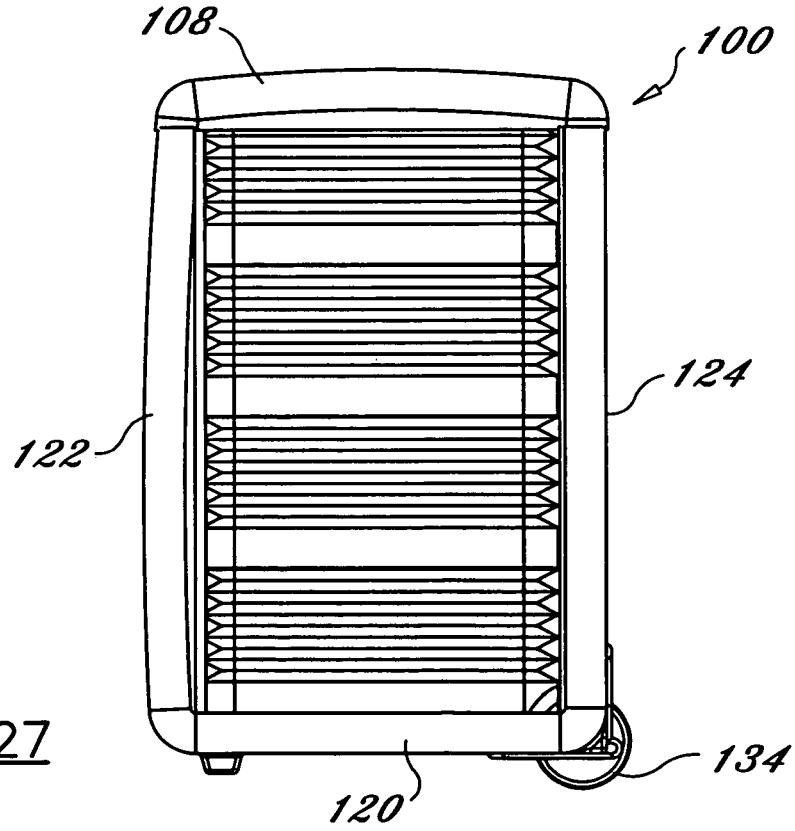
FIG. 27 is a front view thereof (front access panel open)
Figure 28:
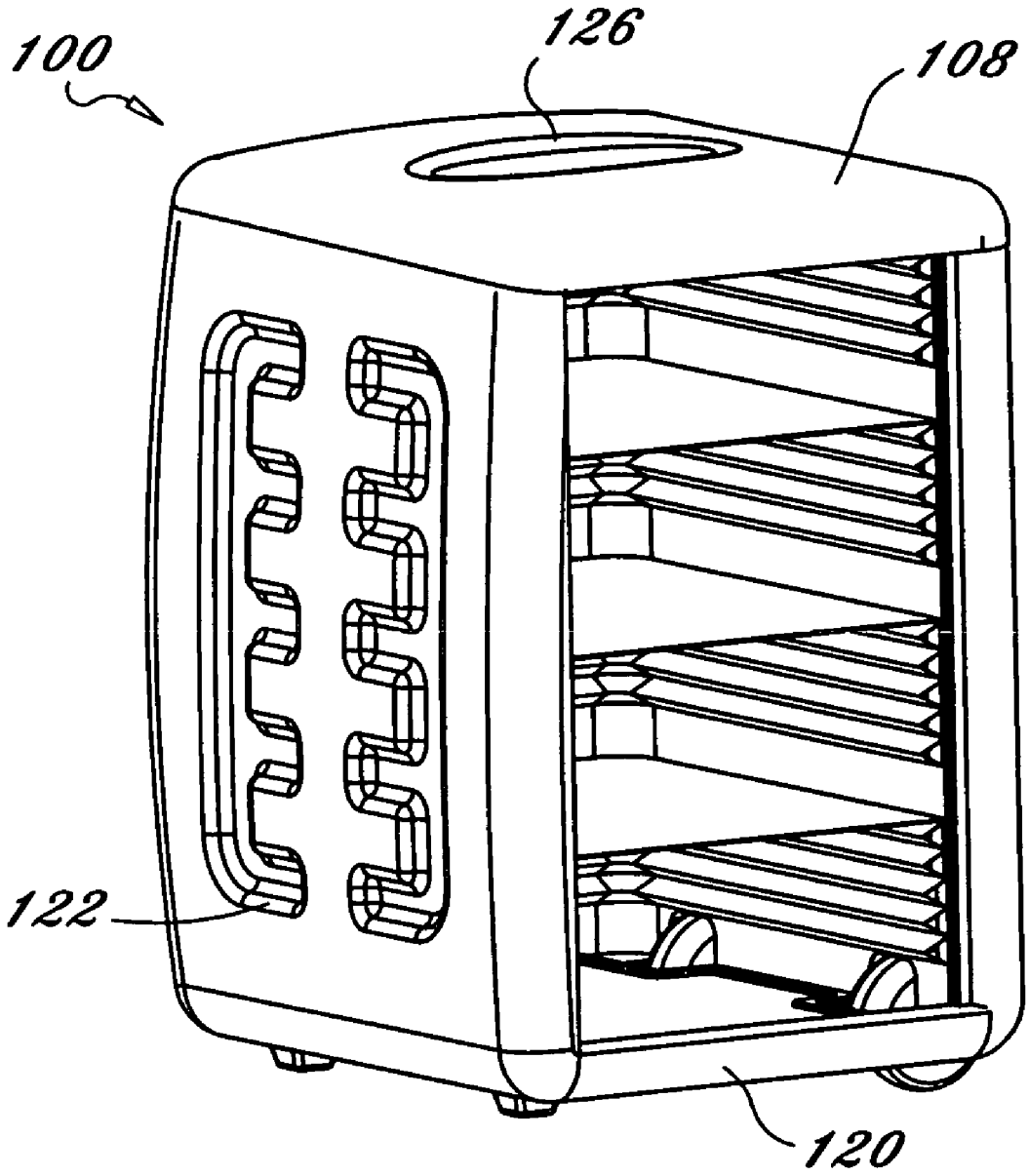
FIG. 28 is a front perspective view thereof.

Folding tool 50 includes a plurality of substantially flat, light-weight panel members including a main panel 52, opposing left and right side panels 54 and 56, and a bottom panel 58. Panels 52, 54, 56, and 58 are preferably fabricated from a light-weight, rigid or semi-rigid material. Side panels 54, 56, and bottom panel 58, are each pivotally connected to main panel 52. The pivotal connections facilitate the folding of panels 54, 56, and 58 about main panel 52 as best seen in FIG. 16. Side panels 54 and 56 preferably define a plurality of apertures, referenced as 62, for reasons more fully discussed below. Apertures 62 are preferably circular, however, any suitable shape (e.g. square, triangular, slotted etc.) is considered within the scope of the invention.

FIG. 16 depicts a side elevational view of the apparatus 50. The bottom surfaces of panels 54 and 56 are preferably slightly raised when apparatus 50 is placed on a flat supporting surface. In a preferred embodiment, projecting feet, referenced as 64, projected downward proximal the peripheral corner edges thereof. Feet 64 function to elevate the edges of the panels to facilitate grasping and manipulation thereof by the user.

Figure 17:
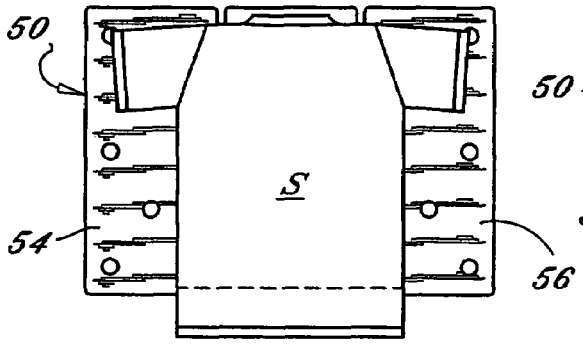
FIG. 17 is a top plan view depicting the garment folding apparatus and an unfolded shirt thereon.
Figure 18:
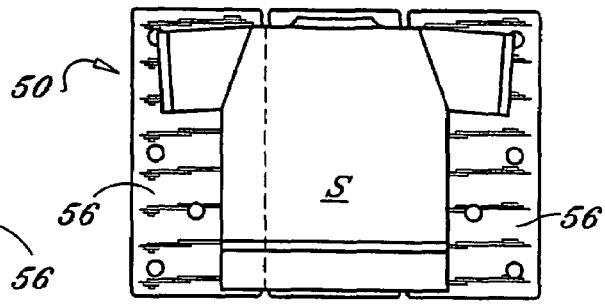
FIG. 18 is a top plan view of the garment folding apparatus and shirt depicted in FIG. 17, with the bottom portion of the shirt folded up according to the folding method disclosed herein.
Figure 19:
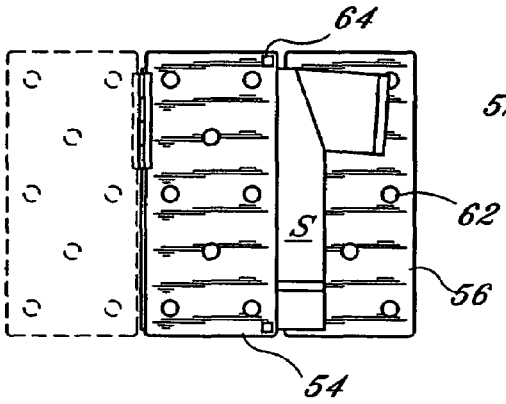
FIG. 19 is a top plan view of the garment folding apparatus and shirt with the left side panel folded over.
Figure 20:
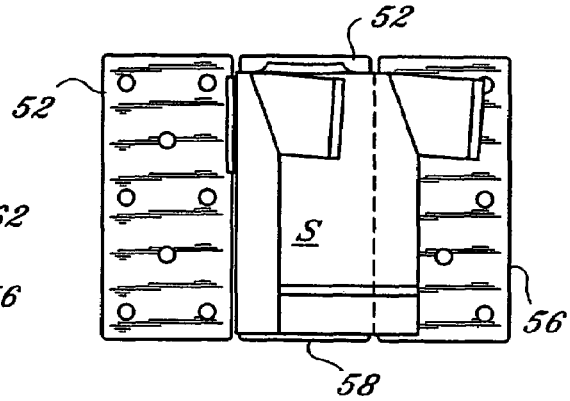
FIG. 20 is a top plan view of the garment folding apparatus and shirt with the left side panel folded back revealing the partially folded shirt.

FIG. 17 shows the garment folding apparatus 50 with a shirt, referenced as "S" placed face down in a folding position thereon. It should be noted that apparatus 50 is preferably sized such that the ends of the shirt sleeves terminate proximal the outside edges of panels 54 and 56 respectively. As best seen in FIG. 18, and according to the method of folding disclosed herein, the first step involves folding the bottom of the shirt such that the shirt fold line is approximately aligned with the lower edges of panels 54, 56 and 58. As best seen in FIG. 19, and according to the method of folding disclosed herein, the second step involves the user flipping panel 54 (or alternatively panel 56), and the shirt portion laying thereon, such that panel 54 is disposed over panels 52 and 58 with the shirt sandwiched there between thereby creating a straight and uniform fold line upon return of the panel to the position depicted in FIG. 20. Projecting feet 64 function to enable the user to easily grasp each foldable panel by causing the edge portion of each panel adapted with said feet to be slightly elevated above the underlying surface thereby enabling the user's fingers to easily slide underneath the panel while grasping.

Figure 21:
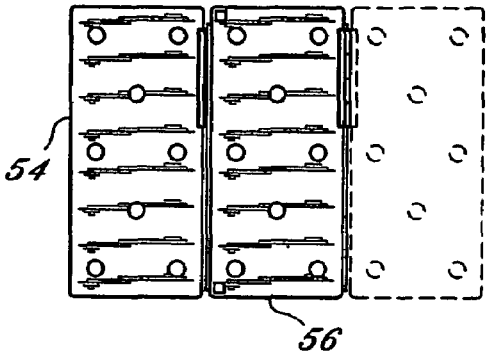
FIG. 21 is a top plan view of the garment folding apparatus and shirt with the right side panel folded over.
Figure 22:
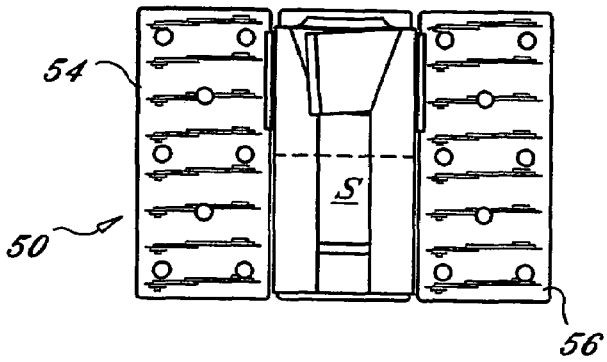
FIG. 22 is a top plan view of the of the garment folding apparatus and shirt with the right side panel folded back revealing the partially folded shirt.

As best seen in FIG. 21, and according to the method disclosed herein, the third step involves the user flipping panel 56, and the shirt portion laying thereon, such that panel 56 is disposed over panels 52 and 58 with the shirt sandwiched there between. Once again, projecting feet 64 function to enable the user to easily grasp the panel. Panel 56 is then returned to its original position as depicted in FIG. 22. It should be noted that the above-referenced second and third steps, and associated returning of the panels to the original positions, are performed rapidly. Significantly, apertures 62, on each of panels 54 and 56 function, upon returning the panels to the original positions to prevent suction and static cling from unfolding the shirt as the panels are rapidly flipped back to the original positions. If the panels did not include the apertures, the rapid return of the panels would cause the shirt to adhere to the panels thereby undoing the fold and resulting in a significantly slower folding operation. Accordingly, apertures 62 provide for a more efficient folding process than is possible with known folding devices.

Figure 23:
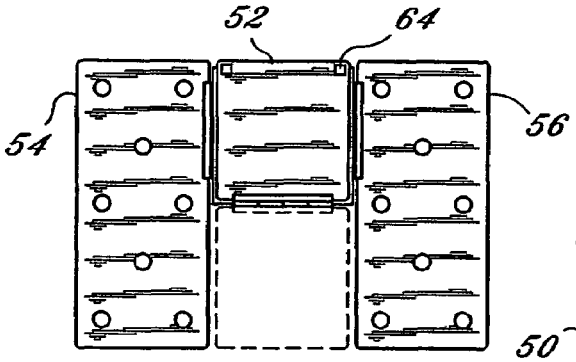
FIG. 23 is a top plan view of the garment folding apparatus and shirt with the bottom panel folded upward.
Figure 24:
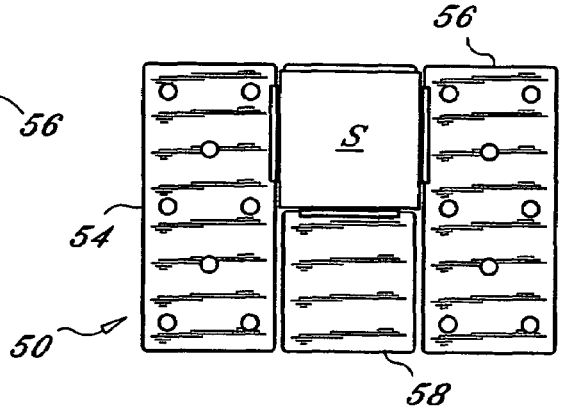
FIG. 24 is a top plan view of the garment folding apparatus and shirt with the bottom panel folded back.

As best seen in FIGS. 23-24, and according to the fourth step of the folding method disclosed herein, panel 58, and the shirt portion thereon, is folded upward thereby completing the folding process. As should be apparent, panel 58 may also include apertures 62 and/or feet 64 to provide the advantages discussed herein above.

Alternate Embodiment

FIGS. 26-41 depict an alternate embodiment of the expandable luggage of the present invention, generally referenced as 100, and generally discloses the best mode for practicing the present invention. As best depicted in FIGS. 26-31, expandable luggage 100 includes a body 102 that defines a generally hollow interior for receiving clothing and the like, and an exterior that may feature various handles, piping, pockets, and the like, as depicted or as otherwise are used in the luggage art. Body 102 has a front 104, a back 106, a top 108, a bottom 120 and two opposing sides 122 and 124. Top 108 preferably includes a handle 126 attached thereto to assist in lifting case 10, and for other reasons discussed herein below. As with all rolling luggage, case 100 is adapted with at least one wheel. In the preferred embodiment case 100 has two wheels 134 rotatably mounted within wheel housings 136 proximate to the lower rear corners of the body 112. Expandable case 100 also preferably includes an extendable handle as is well known in the art for use by the user when rolling.

As disclosed in the first embodiment, a significant aspect of the present invention relates to expandability. The embodiment depicted in FIGS. 26-41 differs in structure from the embodiment depicted in FIGS. 1-12. Specifically, case 100 is adapted with a telescopically adjustable frame assembly having four telescopically adjustable frame members 150 and a telescopically adjustable locking track 152. Locking track 152 includes two telescopically adjustable members and an automatically locking/unlocking mechanism, commonly referred to as a camover latch, that functions to automatically lock and unlock to allow for selective vertical expansion and retraction of frame members 150 as further described herein below. Each telescopically adjustable frame member 150 and locking track 152 is connected at the upper ends thereof to the top portion 108 of case body 102 and at the lower ends thereof to the bottom portion 120 of case 102. Frame members 150 and locking track 152 are telescopically adjustable such that body 102 of case 100 may be vertically manipulated between a compact configuration depicted in FIGS. 26-28 and an expanded configuration depicted in FIGS. 29-31. FIGS. 37-41 depict adjustable frame members 150 and adjustable locking track 152 in a vertically expanded configuration. It should be noted, however, that any suitable system, such as gas operated cylinders or spring mechanism may provide a suitable alternative to frame members 50 and adjustable locking track 152.

A significant advantage to the embodiment depicted in FIGS. 26-41 relates to maintaining body 102 in the expanded configuration by the automatic locking camover latch feature of locking track 152. More particularly, the camover latch feature incorporated within locking track 152 functions to automatically lock track 152 in a telescopically expanded configuration when the user configures the body 102 into the expanded configuration. Similarly, the camover latch incorporated within locking track 152 functions to automatically unlock when the user lifts the top of body 102 slightly thereby releasing an internal locking mechanism and allowing track 152 to return to the telescopically retracted configuration.

In addition, an expandable shelf assembly 140 comprising an expandable liner 142 and a plurality of shelves 144 is connected to frame assembly 150 to provide a series of vertically expandable shelves 144 that expand and contract with frame members 150 and locking member 152. More particularly, an expandable shelf assembly 140 includes an expandable liner 142 having a plurality of horizontal shelves 144 connected thereto in vertically spaced relation. Shelf assembly 140 has an upper end secured to the top portion 108 of case body 102, and lower end secured to the bottom portion 120 of case 102. The plurality of horizontal shelves may be used for storing neatly folded clothing and personal items within case 100.

Figure 29:
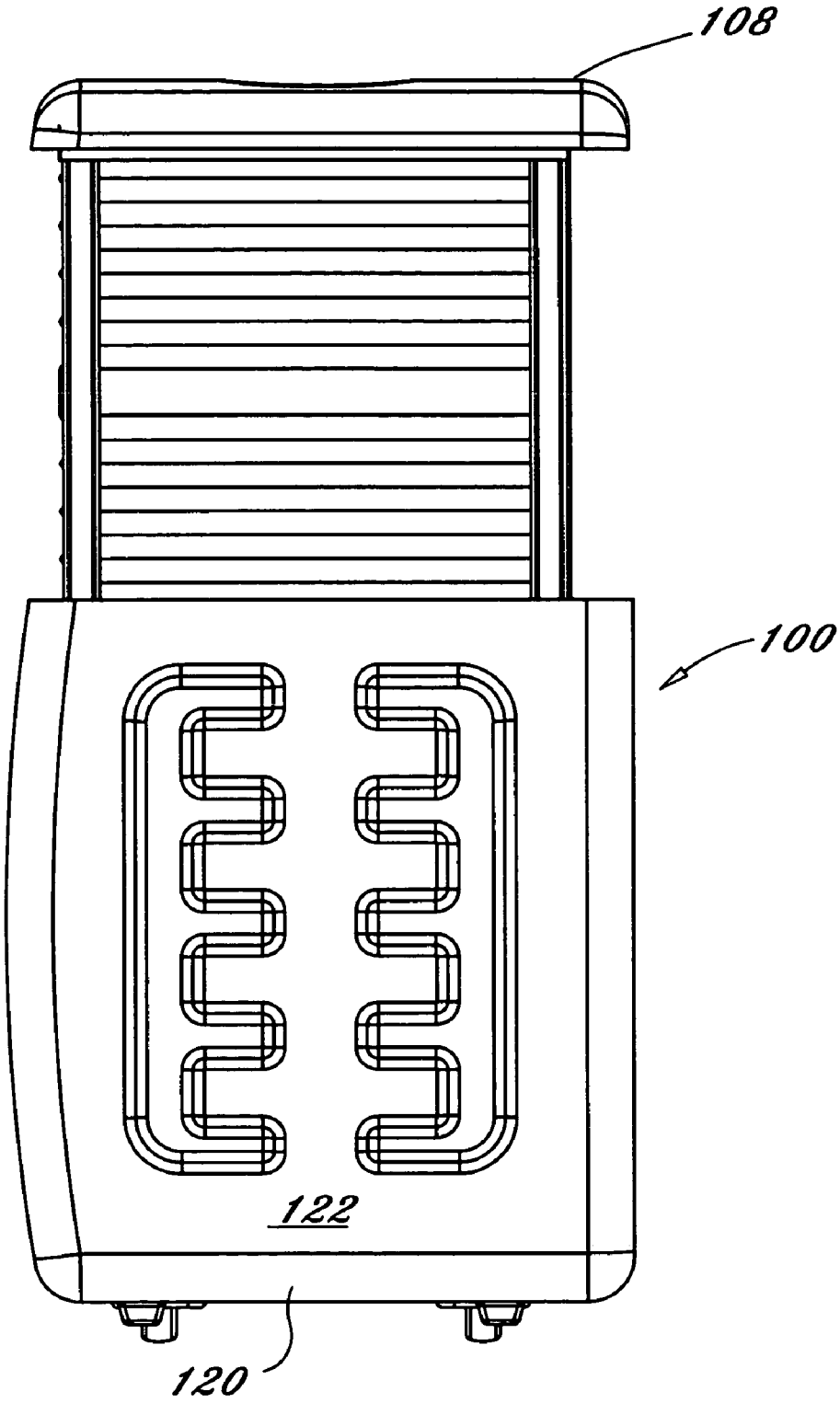
FIG. 29 is a left side view thereof in the vertically expanded configuration.
Figure 30:
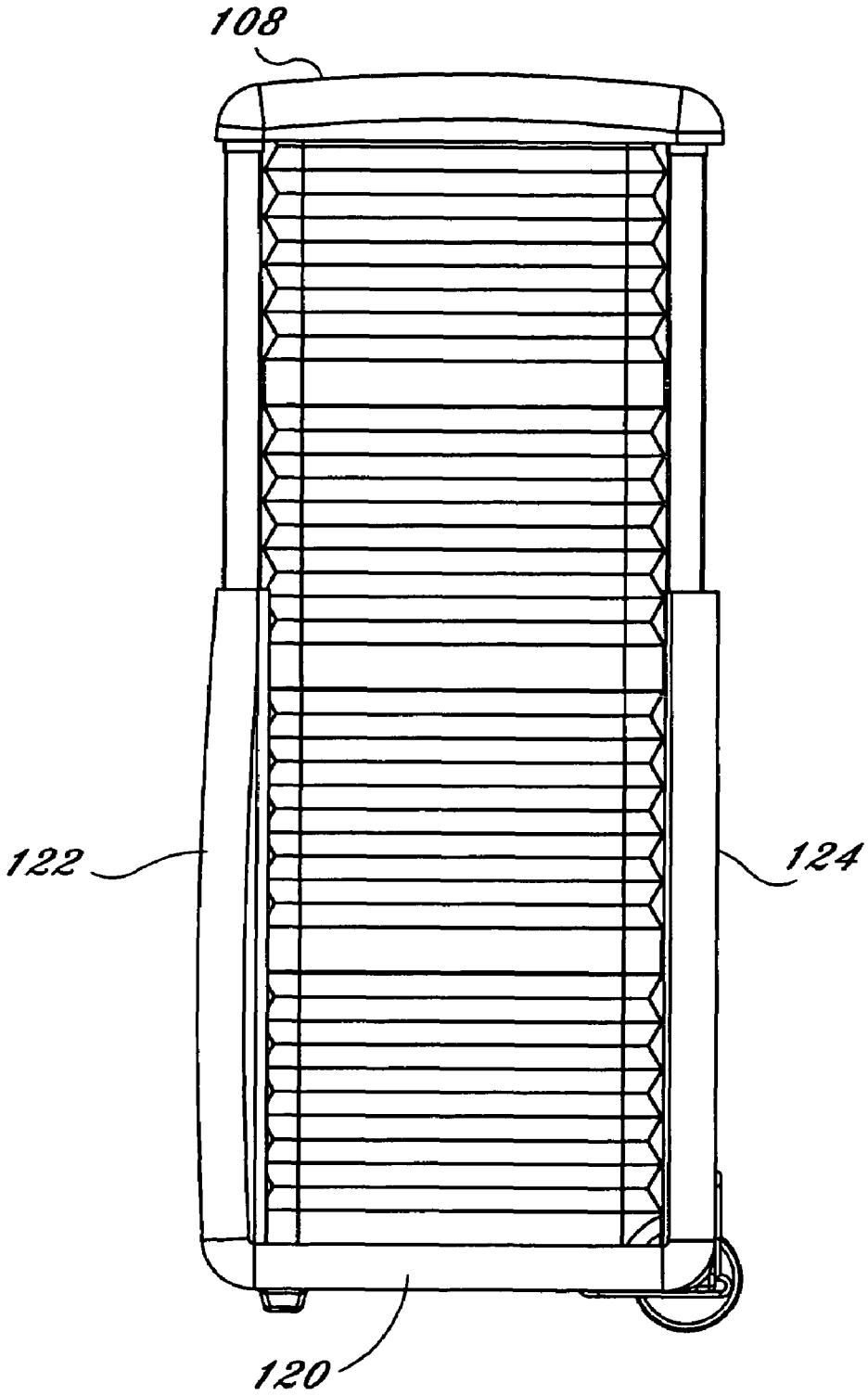
FIG. 30 is a front view thereof.
Figure 31:
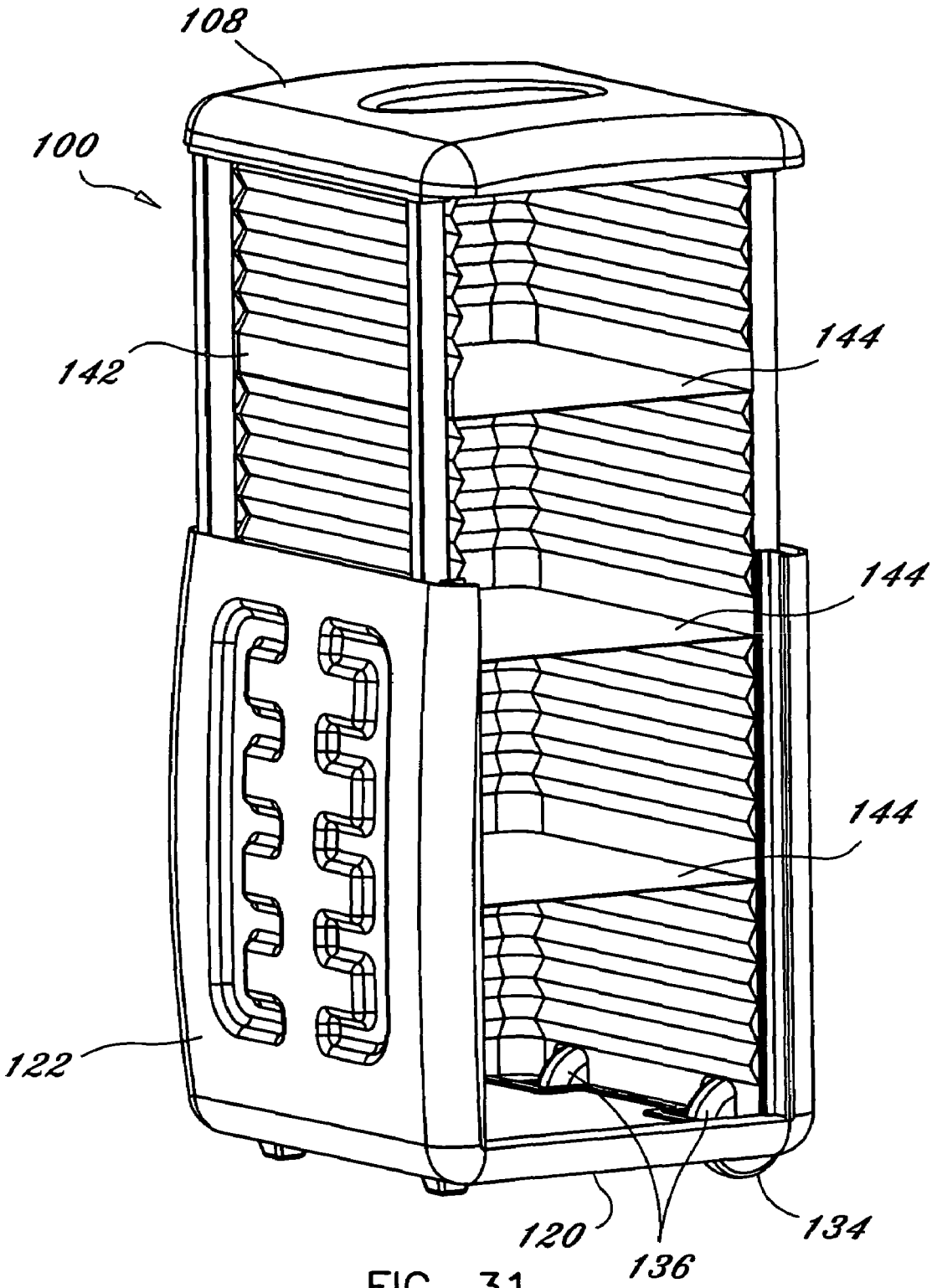
FIG. 31 is a front perspective view thereof.
Figure 32:
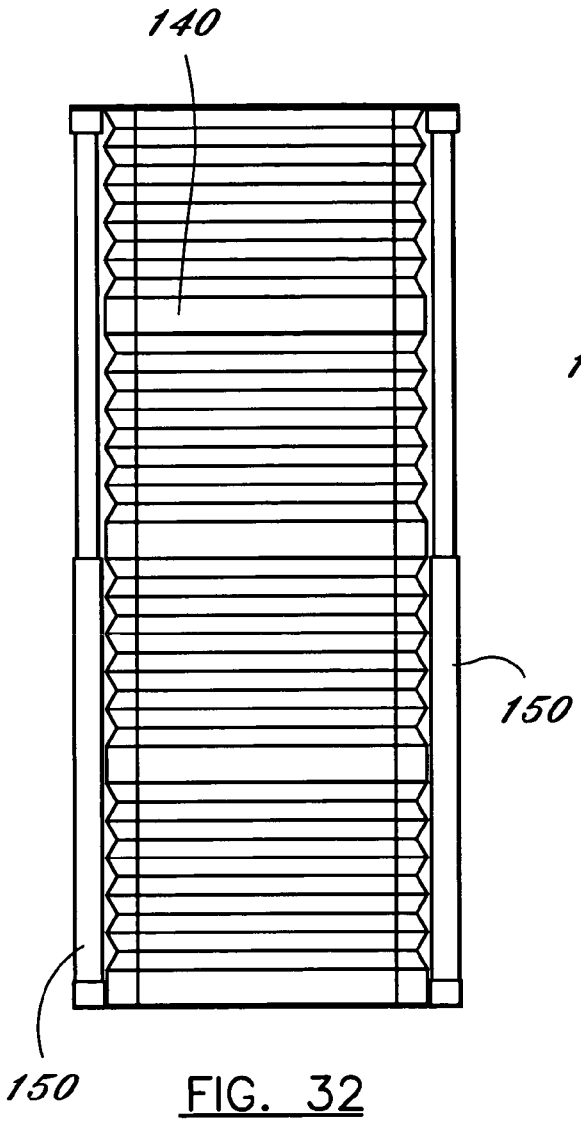
FIG. 32 is a front view of the expandable frame assembly and expandable shelves.
Figure 33:
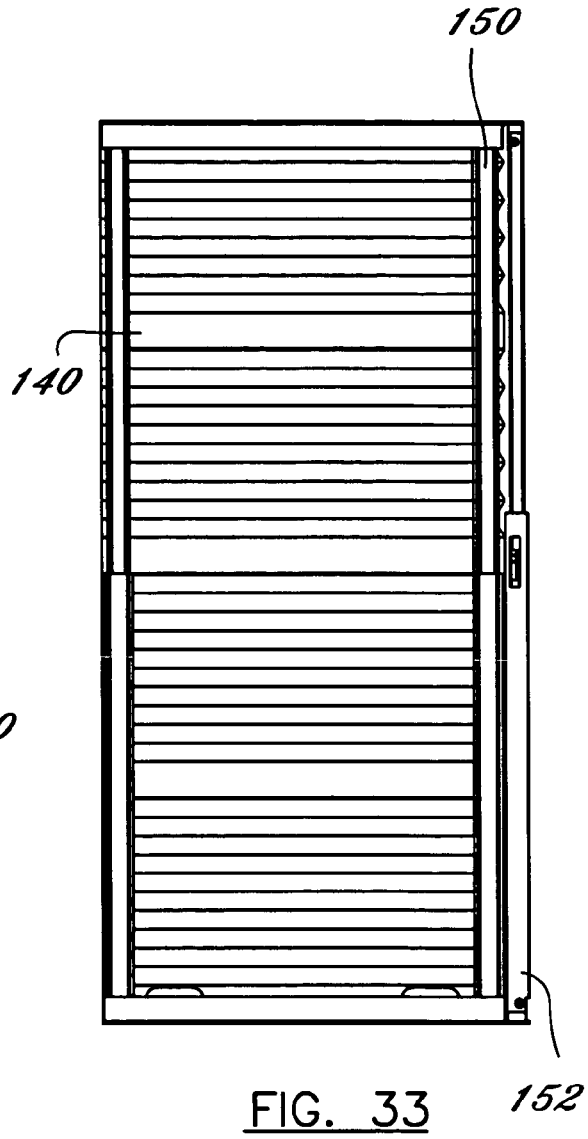
FIG. 33 is a right side view thereof.
Figure 34:
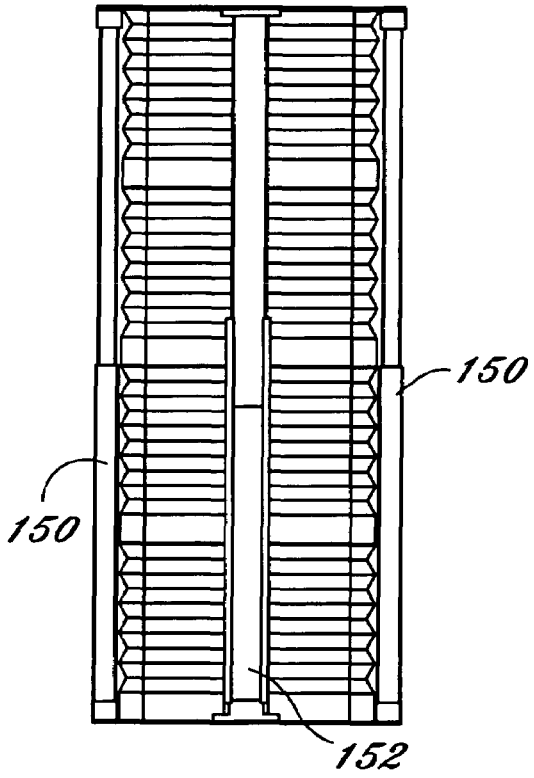
FIG. 34 is a rear view thereof.
Figure 35:
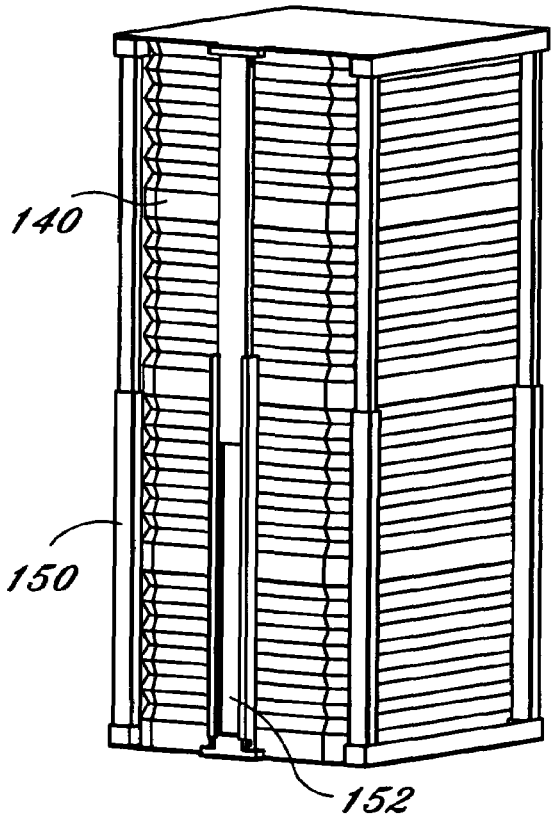
FIG. 35 is a rear perspective view thereof.
Figure 36:
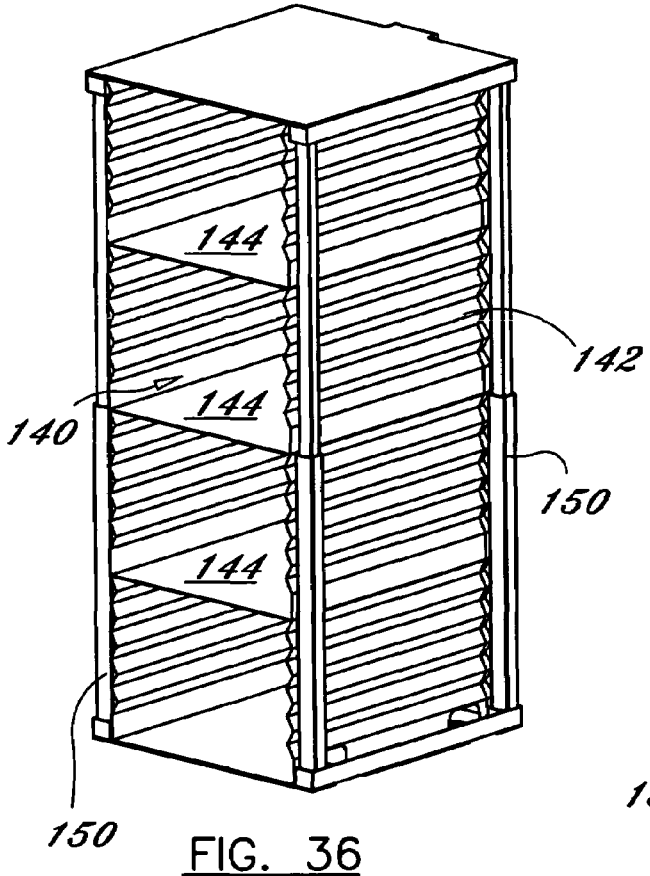
FIG. 36 is a front perspective view thereof.
Figure 37:
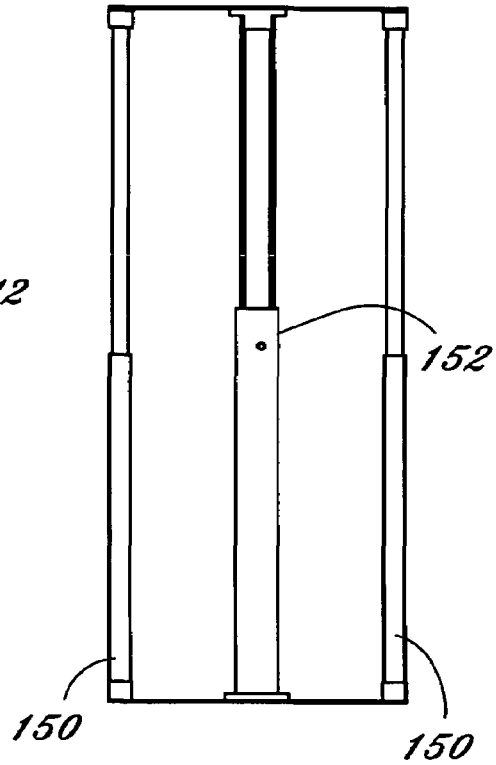
FIG. 37 is a rear view of the expandable frame assembly.
Figure 38:
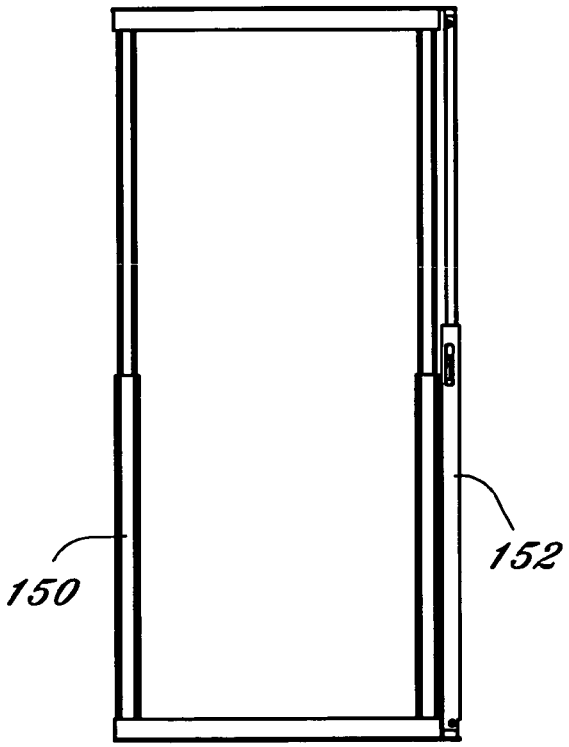
FIG. 38 is a right side view thereof.
Figure 39:
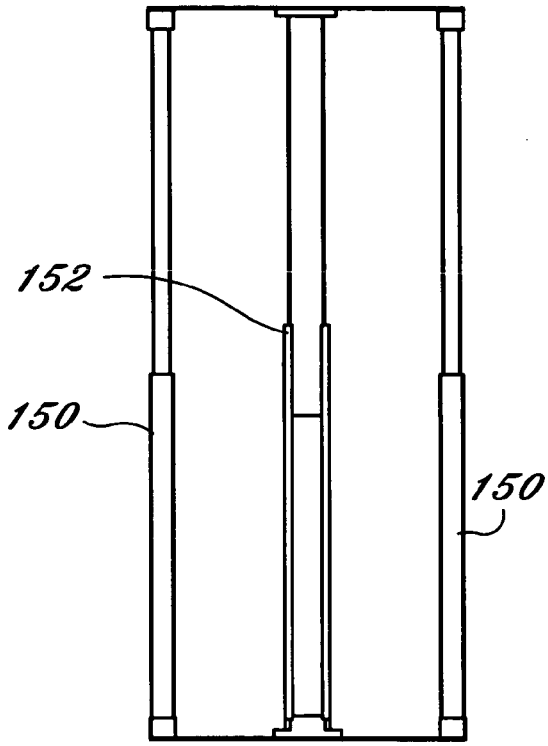
FIG. 39 is a rear view thereof.
Figure 40:
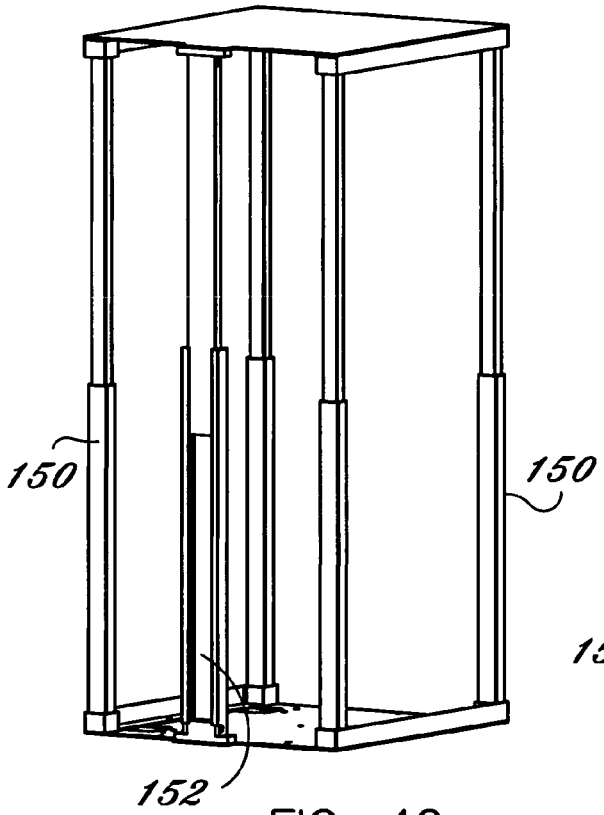
FIG. 40 is a rear perspective view thereof.
Figure 41:
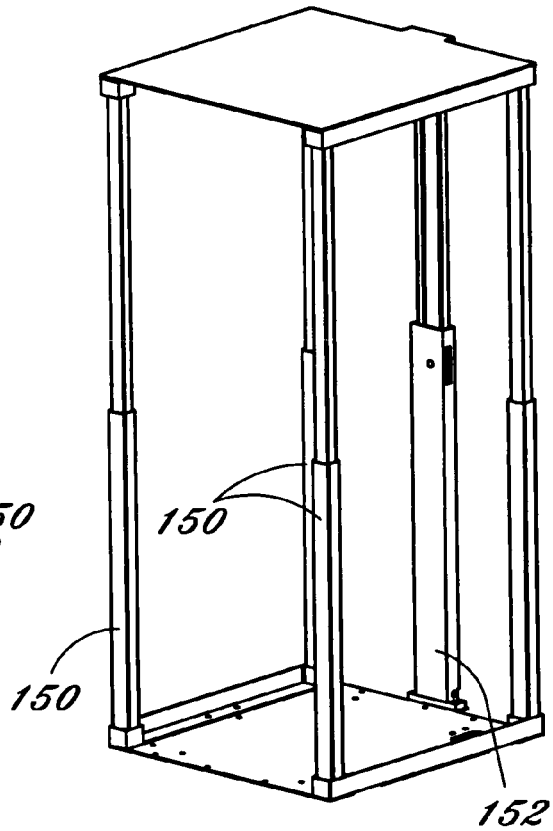
FIG. 41 is a front perspective view thereof.

As discussed herein above, each shelf 144 is preferably attached to an internal, vertically expandable liner 144 having an upper end connected to the top portion 108 of body 102 and a bottom portion connected to the bottom 120 of body 102 so as to expand upward in an accordion manner when case 100 is configured to the expanded configuration depicted in FIGS. 29-31. By incorporating an expandable shelving system within case 100, the user may configure the case to the expanded configuration depicted in FIG. 31 while packing the case, then close the case by configuring same to the compact configuration depicted in FIG. 28 wherein case 100 may be transported during travel. Significantly, the vertical spacing between shelf members 144 decreases when case 100 is in the compact configuration thereby preferably slightly compressing the clothing and articles thereon so as to secure the articles during transit. Once the user has arrived at his/her destination, case 100 may be opened and configured to the expanded configuration depicted in FIG. 31, thereby increasing the vertical spacing of shelves 40. In the expanded configuration, the clothing and personal items stored within the case remain neatly stacked, and readily accessible due to the expansion of the interior volume and increased vertical spacing between individual shelf members. The present invention thus provides an expandable case that saves the user significant time while traveling since the user may leave his/her clothing and personal items neatly within the case and thus is relieved of the duties related to unpacking the case.

The apparatus may be constructed to any suitable size. For example, one size apparatus may be configured for adult clothing and another size apparatus may be configured for children's clothing merely by altering the dimensions of the panels.

The instant invention has been shown and described herein in what is considered to be the most practical and preferred embodiment. It is recognized, however, that departures may be made therefrom within the scope of the invention and that obvious modifications will occur to a person skilled in the art.

We claim:

1. A wheeled luggage comprising:

a main body defining an internal compartment bounded by a bottom wall, a top wall, an openable front, a rear wall and two opposing side walls;

said internal compartment including at least one shelf;

said body adapted for vertical adjustability whereby said body may be configured from a compact configuration to an expanded configuration wherein the volume of said internal compartment is increased;

a removable garment folding tool adapted to form a front closure panel;

at least one wheel connected proximal said bottom wall for free rotation; and a retractable handle assembly having a first end attached to said case body, said retractable handle assembly being extendable from a retracted position.

2. A wheeled luggage according to claim 1, wherein said garment folding tool comprises four connected panel members.

3. A wheeled luggage according to claim 1, wherein said openable front includes:

means for removably attaching said garment folding tool to said main body in convering relation with said front.

4. A wheeled luggage comprising:

a main body defining an internal compartment bounded by a bottom wall, a top wall, an openable front, a rear wall and two opposing side walls;

said internal compartment containing an expandable liner having a plurality of vertically spaced shelves connected thereto, said expandable liner having a upper portion fixed relative to said top wall and a bottom portion fixed relative to said bottom wall;

said body adapted for vertical expansion whereby said body may be configured from a compact configuration wherein said top wall and said bottom wall are spaced a first dimension relative to one another, to a vertically expanded configuration wherein said top wall and said bottom wall are spaced a second dimension relative to one another, said second dimension being greater than said first dimension such that the volume of said internal compartment is increased;

said vertical spacing between said shelves decreasing when said body is configured from said expanded configuration to said compact configuration;

means for automatically locking said body in said vertically expanded configuration when said body is configured to said vertically expanded configuration from said compact configuration;

at least one wheel connected proximal said bottom wall for free rotation; and a retractable handle assembly having a first end attached to said case body, said retractable handle assembly being extendable from a retracted position.

5. A wheeled luggage according to claim 4, wherein said means for automatically locking said body in said vertically expanded configuration comprises at least one telescopically expandable locking track.

* * * * *